US005475471A

United States Patent [19]

Kisu et al.

[11] Patent Number: 5,475,471

[45] Date of Patent: Dec. 12, 1995

[54] CHANGING MEMBER HAVING A CHARGING SURFACE ARRANGED WITH RESPECT TO A TANGENT LINE

[75] Inventors: Hiroki Kisu, Fujisawa; Kazushige Sakurai; Michihito Yamazaki, both of Tokyo; Erika Asano, Kawasaki; Satoru Inami, Tokyo; Hiroaki Ogata, Kawasaki; Tetsuya Sano, Yokohama, all of Japan

[73] Assignee: Canon Kabushiki Kaisha, Tokyo, Japan

[21] Appl. No.: 998,858

[22] Filed: Dec. 30, 1992

[30] Foreign Application Priority Data

| | | | |
|---|---|---|---|
| Jan. 10, 1992 | [JP] | Japan | 4-021726 |
| Jan. 10, 1992 | [JP] | Japan | 4-021728 |
| Nov. 13, 1992 | [JP] | Japan | 4-327520 |
| Dec. 15, 1992 | [JP] | Japan | 4-334519 |

[51] Int. Cl.[6] ..... G03G 15/00

[52] U.S. Cl. ..... 355/219; 355/221

[58] Field of Search ..... 355/219, 227, 355/221, 222; 361/221, 225

[56] References Cited

U.S. PATENT DOCUMENTS

| | | | |
|---|---|---|---|
| 4,380,384 | 4/1983 | Ueno et al. | 355/219 |
| 5,206,784 | 4/1993 | Kimiwada et al. | 355/225 X |
| 5,272,505 | 12/1993 | Shishido et al. | 355/219 |

FOREIGN PATENT DOCUMENTS

| | | |
|---|---|---|
| 63-149669 | 6/1988 | Japan . |
| 3-240076 | 10/1991 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A charging device, for use with an image forming apparatus with a detachable process cartridge, includes a movable member to be charged, and a charging member adjacent to the movable member. An oscillating voltage is applied to the charging member. The charging member includes a charging surface at the same side as the movable member. A tangent line extends from a point on the charging member, the point being the most downstream point in a moving direction of the movable member at a closest portion between the charging member and the image bearing member, toward the downstream side in the moving direction of the movable member. The charging device may include a first charging region and a second charging region provided at a downstream side from the first charging region, wherein a peak-to-peak voltage of unevenness in charging of a potential of the first charging region is greater than a peak-to-peak voltage of unevenness in charging of a potential of the second charging region.

66 Claims, 28 Drawing Sheets

CHANGING MEMBER HAVING A CHARGING SURFACE ARRANGED WITH RESPECT TO A TANGENT LINE

BACKGROUND OF THE INVENTION

1. Field of the Invention

This invention relates to a charging device for charging a member to be charged, such as a photosensitive member, a dielectric member or the like, an image forming apparatus which uses this device, and a process cartridge which is detachable to this apparatus.

2. Description of the Related Art

Heretofore, in an image forming apparatus, such as an electrophotographic apparatus (a copier, a laser-beam printer or the like), an electrostatic recording apparatus or the like, noncontact-type charging means, in which a corona discharging unit including a wire and a shield is used, and the surface of a member to be charged, such as an image bearing member (for example, a photosensitive member or a dielectric member) or the like, is exposed to corona generated by the unit, have been widely used as means for performing charging processing (including charge-removing processing) of the member to be charged.

Recently, contact-type charging means, which perform contact charging, have been more and more adopted. In contact charging, a voltage is applied, for example, to a roller-type or blade-type charging member (a contact charging member comprising a conductive member), and the surface of a member to be charged is charged by making the charging member in contact with or in the proximity of the member to be charged.

The charging member need not always contact the surface of the member to be charged, and may not contact (or be in the proximity of) the surface of the member to be charged, provided that a chargeable region, which is determined by the gap voltage and the correction Paschen curve, can be secured between the charging member and the member to be charged.

Contact-charging or proximity-charging units have, for example, the following advantages compared with noncontact-charging corona charging units. That is, the value of an applied voltage necessary for obtaining a desired potential on the surface of a member to be charged can be reduced. The amount of ozone generated in a charging process is very small, and therefore the use of an ozone-removing filter is unnecessary. Hence, the configuration of an exhaust system of the apparatus can be simplified. A maintenance-free apparatus can be provided. The configuration of the apparatus can be simplified.

As previously proposed by the assignee of the present application (for example, Japanese Patent Application Laid-open (Kokai) No. 63-149669 (1988)) with respect to contact charging, a method of performing charging by applying an oscillating voltage (a voltage whose value periodically changes with time), more particularly, an oscillating voltage whose peak-to-peak voltage is at least twice the charging-start voltage of a member to be charged when a DC voltage is applied (hereinafter termed an AC application method) can perform uniform charging (including charge-removing) processing, and therefore is effective.

FIG. 9 illustrates the schematic configuration of an image forming apparatus which adopts a contact charging unit of the above-described AC application method as charging means for an image bearing member. The apparatus comprises a laser-beam printer which utilizes an electrophotographic process.

A drum-type electrophotographic photosensitive member (hereinafter termed a photosensitive drum) 1, serving as a member to be charged, is rotatably driven at a predetermined peripheral speed (process speed) in a clockwise direction, as indicated by arrow A.

Charging roller (conductive roller) 20, serving as a charging member, comprises a metal core bar 21, and a conductive roller member 22, made of conductive rubber or the like, formed at the outer circumference of metal core bar 21. Charging roller 20 is in pressure contact with the surface of photosensitive drum 1 with a predetermined pressure given by pressing springs 23 provided at both end portions of metal core bar 21. In the present case, charging roller 20 is rotatably driven in accordance with the rotation of photosensitive drum 1.

Reference numeral 4 represents a power supply for applying a voltage to charging roller 20. Power supply 4 applies a superposed voltage ($V_{ac}+V_{dc}$), comprising a AC-component voltage $V_{ac}$, whose peak-to-peak voltage equals at least twice the charging start voltage for photosensitive drum 1, and a DC-component voltage Vdc, to charging roller 20 via contact leaf spring 3 contacting metal core bar 21 of charging roller 20, whereby the outer circumferential surface of the rotatably-driven photosensitive drum 1 is subjected to uniform contact charging by the AC application method.

On the other hand, a time-serial electrical digital pixel (picture element) signal of target image (printing) information is input from a host apparatus (not shown), such as a computer, a word processor, an image reading apparatus or the like, to a laser scanner (not shown). The laser scanner controlled by a controller outputs laser light 5 subjected to image modulation with a constant printing density $D_{dpi}$ in accordance with the input pixel signal. By performing line scanning (main-scanning exposure in the direction of the generatrix of the drum) of the output laser light 5 for the charged surface of the rotating photosensitive drum 1, the target image information is written to form an electrostatic latent image of the image information on the surface of the rotating photosensitive drum 1.

The latent image is visualized as a toner image by performing reversal development using developing sleeve 6 of a developing unit. The toner image is sequentially transferred onto transfer material 7 fed from a sheet-feeding unit (not shown) to a pressure-contact nip portion (transfer portion) between photosensitive drum 1 and transfer roller 8 with a predetermined timing.

Transfer material 7 onto which the toner image has been transferred is separated from the surface of photosensitive drum 1 and conveyed to fixing means (not shown), where the toner image is fixed. Transfer material 7 on which the toner image has been fixed is output as an image-formed material. The surface of the rotating photosensitive drum 1 after separating transfer material 7 is cleaned by removing any remaining deposit, such as remaining toner after transfer, or the like, using cleaning blade 9 of a cleaner, and is repeatedly used for image formation.

The above-described image forming apparatus which utilizes a charging unit of the AC application method as charging means for an image bearing member, such as a photosensitive drum or the like, has the following problem.

That is, as shown in FIG. 12, when an image having lateral-line pattern 14*a* indicated by solid lines (reference numeral 14 represents recording paper) is output, if the interval of lateral-line pattern 14*a* is close to the interval of so-called "cycle pattern" 14*b* indicated by broken lines in the surface potential of the photosensitive drum which is determined by the frequency of the AC component of the voltage applied to a member to be charged from the power supply, interference fringes (a moiré pattern) 14*c* appear on the image surface.

The frequency f of the AC component of the power supply has variations of plus or minus 10% from a determined value due to insufficient accuracy in the components, or the like. Accordingly, the frequencies of some power supplies become close to the spatial frequency of lateral-line pattern 14*a*, causing generation of distinct interference fringes 14*c*.

In order to overcome the above-described problem, a method may be considered in which the frequency of the AC component of the power supply is increased in accordance with an increase in the process speed. However, a recent increase in the process speed in accordance with a tendency toward high-speed image forming apparatuses causes an increase in so-called "charging tone" generated with the frequency of the primary power supply in accordance with an increase in the frequency of the primary power supply.

The peak-to-peak interval of the cycle pattern increases and therefore becomes noticeable when the process speed is high or the frequency of the primary power supply is relatively small, since the pitch of charging and discharging in the surface potential of the photosensitive drum caused by the charging member increases.

SUMMARY OF THE INVENTION

It is an object of the present invention to provide a charging device, a process cartridge and an image forming apparatus in which the cycle pattern is less noticeable.

It is another object of the present invention to provide a charging device, a process cartridge and an image forming apparatus in which image interference fringes are reduced.

It is still another object of the present invention to provide a charging device, a process cartridge and an image forming apparatus in which charging tone is reduced.

These and other objects, advantages and features of the present invention will become more apparent from the following detailed description of the preferred embodiments taken in conjuction with the accompanying drawings.

DETAILED DESCRIPTION OF THE PREFERRED EMBODIMENTS

A. Cause of Generation of "Interference Fringes"

Figure 9:
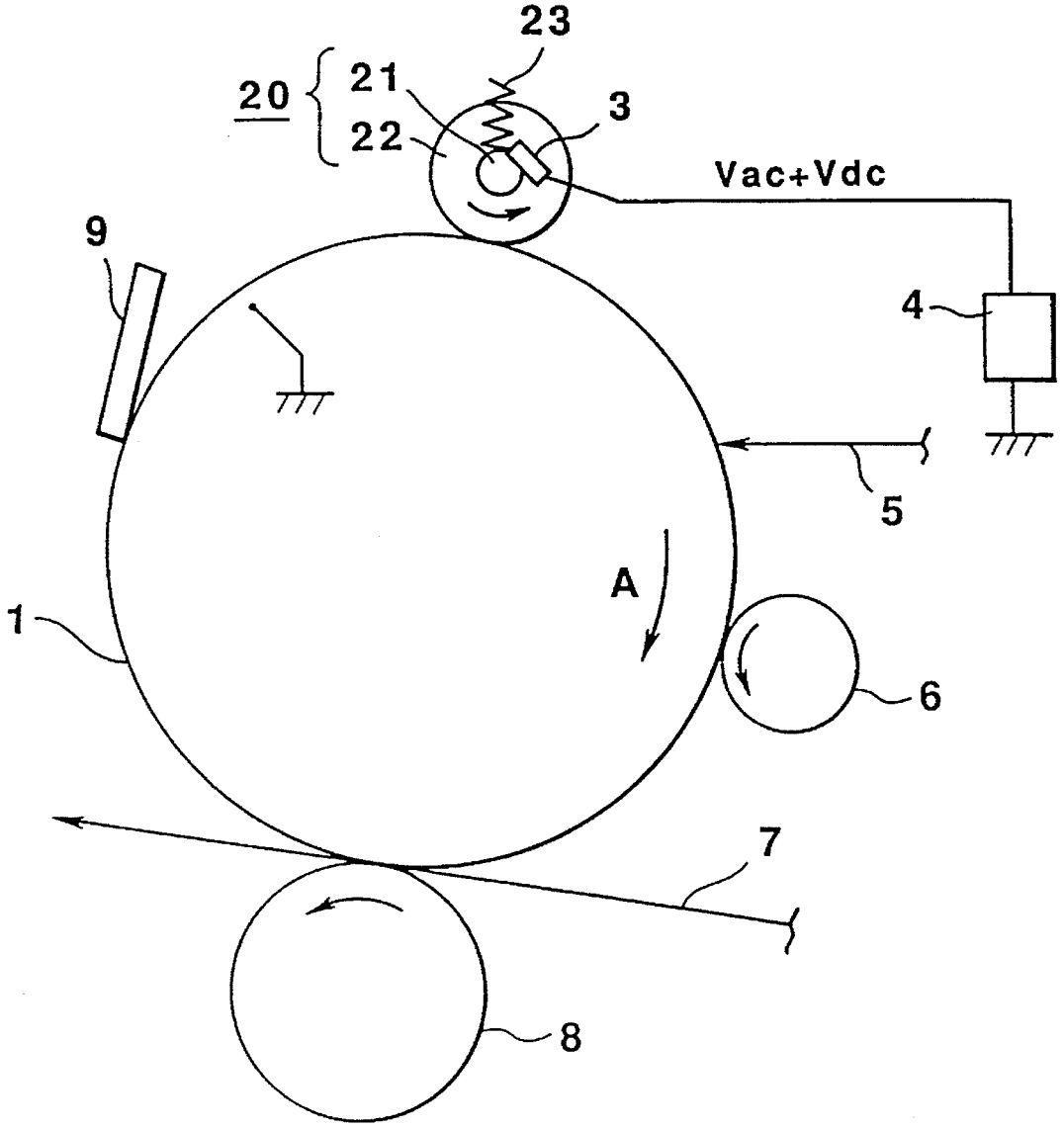
FIG.9 PRIOR ART
FIG. 9 is a diagram showing the schematic configuration of a conventional image forming apparatus.

An additional description is provided of the cause of generation of interference fringes 14*c* with reference to the laser-beam printer shown in FIG. 9 as follows.

(1) The frequency of the oscillating voltage component applied to the charging member is represented by f, (2) the surface moving speed (circumferential rotation speed) of photosensitive drum (image bearing member) 1 as the process speed of the apparatus is represented by $V_p$, (3) the spatial frequency of charging is represented by $\lambda_{sp}$ ($=V_p/f$), (4) the printing density of line scanning is represented by $D_{dpi}$ (dots per inch), (5) the line width of line scanning is represented by n dots, (6) the interval between lines is represented by m spaces, (7) the diameter of one dot is represented by d (= 25.4/D), and (8) the line pitch of lines formed by repeating n dots and m spaces is represented by $L_p$ (=(n+m)d).

Figure 13:
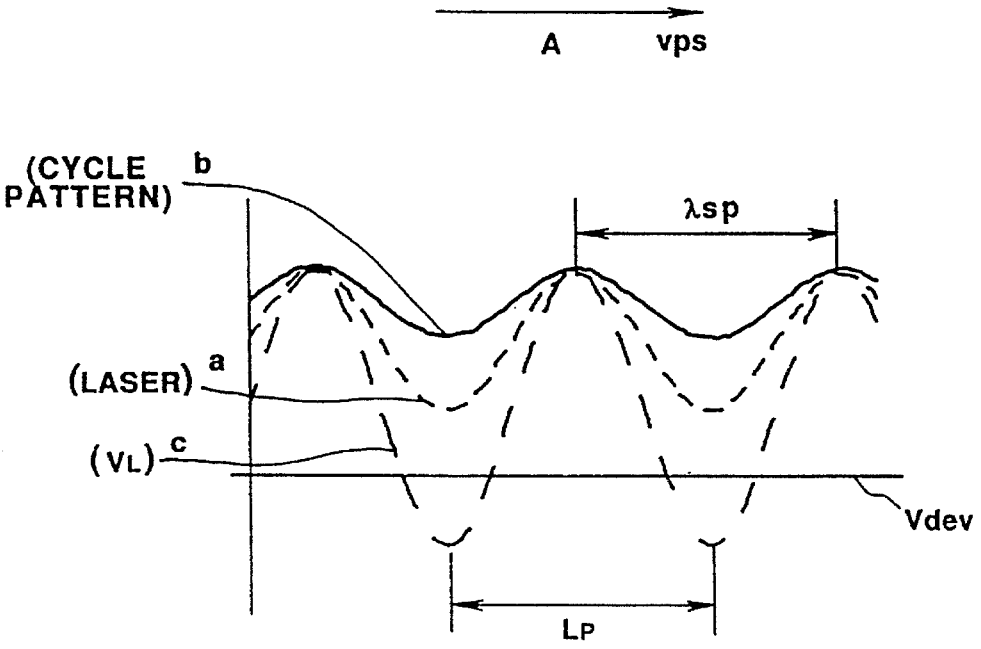
FIG.13(1) PRIOR ART
FIGS. 13(1) and 13(2) are graphs illustrating the cause of generation of interference fringes.
Figure 13:
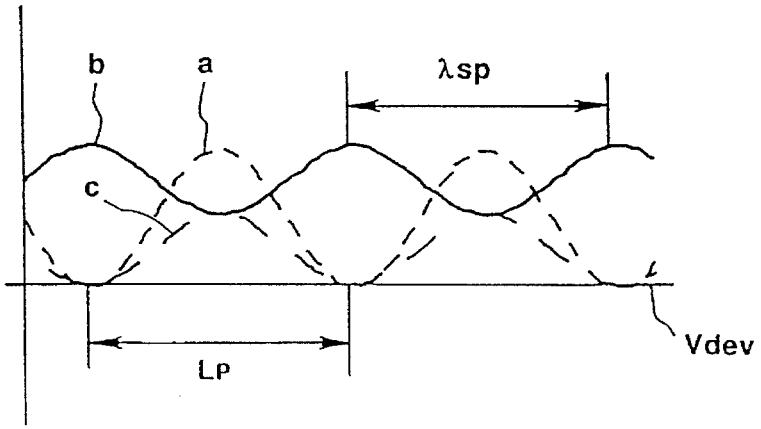
FIG.13(2) PRIOR ART

In FIGS. 13(1) and 13(2), the abscissa represents the length of the photosensitive drum in the moving direction, and the ordinate represents the potential level or the density level. Curves "a" indicated by fine broken lines represent on-off-states of the laser, in which the laser is turned off at hill portions and turned on at valley portions. Curves "b" indicated by solid lines represent a cycle pattern on the photosensitive drum charged by the charging member to which the oscillating voltage is applied. Curves "c" indicated by coarse broken lines represent the potential ($V_L$) of light portions on the photosensitive drum illuminated luminated by the turned-on laser. Arrow A indicates the surface moving direction of the photosensitive drum. While the laser is turned on, the surface of photosensitive drum 1 is subjected to line scanning in the main scanning direction.

The length $L_p$ between the two adjacent turned-on states of the laser, that is, the line pitch, can be obtained using the following expression. It is assumed that lateral lines 14*a* comprising one dot and one space are output with a printing density of 400 dpi.

First, the diameter d of one dot in the case of 400 dpi is expressed by:

$$d=25.4\times1000/400=63.5\ \mu m\ (1\ \text{inch}=25.4\ mm).$$

For the lateral lines comprising n dots and m spaces (n=m=1), $$L_p=(n+m)d=127.0\ \mu m \quad (1).$$

In the state of n dots and m spaces, after exposing n dots (corresponding to the line width) in the sub-scanning direction by turning on the laser while performing line scanning for photosensitive drum 1, a space corresponding to m dots is provided in the sub-scanning direction by turning off the laser. Such an operation is repeated.

In contact charging, the charging distance between photosensitive drum 1 and charging roller 20 is much smaller than in the case of corona charging. Hence, charging conditions are easily influenced by variations in power supply 4. That is, as indicated by the solid-line curves "b" of FIGS. 13(1) and 13(2), potential $V_D$ of dark portions on photosensitive drum 1 has an unevenness in charging termed a "cycle pattern" having a spatial wavelength $\lambda_{sp}$ ($=V_p/f$) which is determined by the frequency f of the oscillating voltage component of power supply 4 and process speed $V_p$.

The peak-to-peak interval of the cycle pattern increases and therefore becomes noticeable when the process speed is high or the frequency of the primary power supply is relatively small, since the pitch of charging and discharging in the surface potential of photosensitive drum 1 by charging member 20 increases.

As described above, the spatial wavelength $\lambda_{sp}$ of the cycle pattern more or less changes due to variations in the frequency or the process speed. The value of the spatial wavelength $\lambda_{sp}$ can be measured in the following manner.

First, after uniformly charging photosensitive drum 1 by charging roller 20, the entire surface of photosensitive drum 1 is uniformly exposed. The amount of exposure is adjusted to a level such that the cycle pattern on photosensitive drum 1 can be clearly developed. After this process, the developed cycle pattern is transferred onto transfer paper, and then the transferred image is fixed. By measuring the cycle pattern on the transfer paper using a magnifying lens, it is possible to measure the range of variations of spatial wavelength $\lambda_{sp}$.

If it is assumed that the process speed $V_p$=12 πmm/s and the frequency f=300 Hz, $$\lambda_{sp}=125.6\ \mu m.$$

Hence, the line pitch $L_p$=127.0 μm substantially equals the spatial wavelength $\lambda_{sp}$=125.6 μm. If the phases of the line pitch and the spatial wavelength coincide, the drop of the potential of light portions below the developing bias voltage $V_{dev}$ increases, as shown by curve "c" indicated by coarse broken lines which represents the potential $V_L$ of light portions in FIG. 13(1). Hence, the developed lines become thick (a reversal phenomenon). On the other hand, if the phases of the line pitch $L_p$ and the spatial wavelength $\lambda_{sp}$ shift by half the wavelength, as shown in FIG. 13(2), the developed lines becomes thin.

Particles of toner, silica, paper and the like adhere to a part of the surface of charging roller 2O after several cycles of charging operations, causing an extra electrostatic capacity for that part. Accordingly, even if the same voltage is applied to metal core bar 21 of charging roller 20 from power supply 4, there is a difference in the phase of the surface potential induced on photosensitive drum 1 between the part having the extra electrostatic capacity and the other part.

Figure 12:
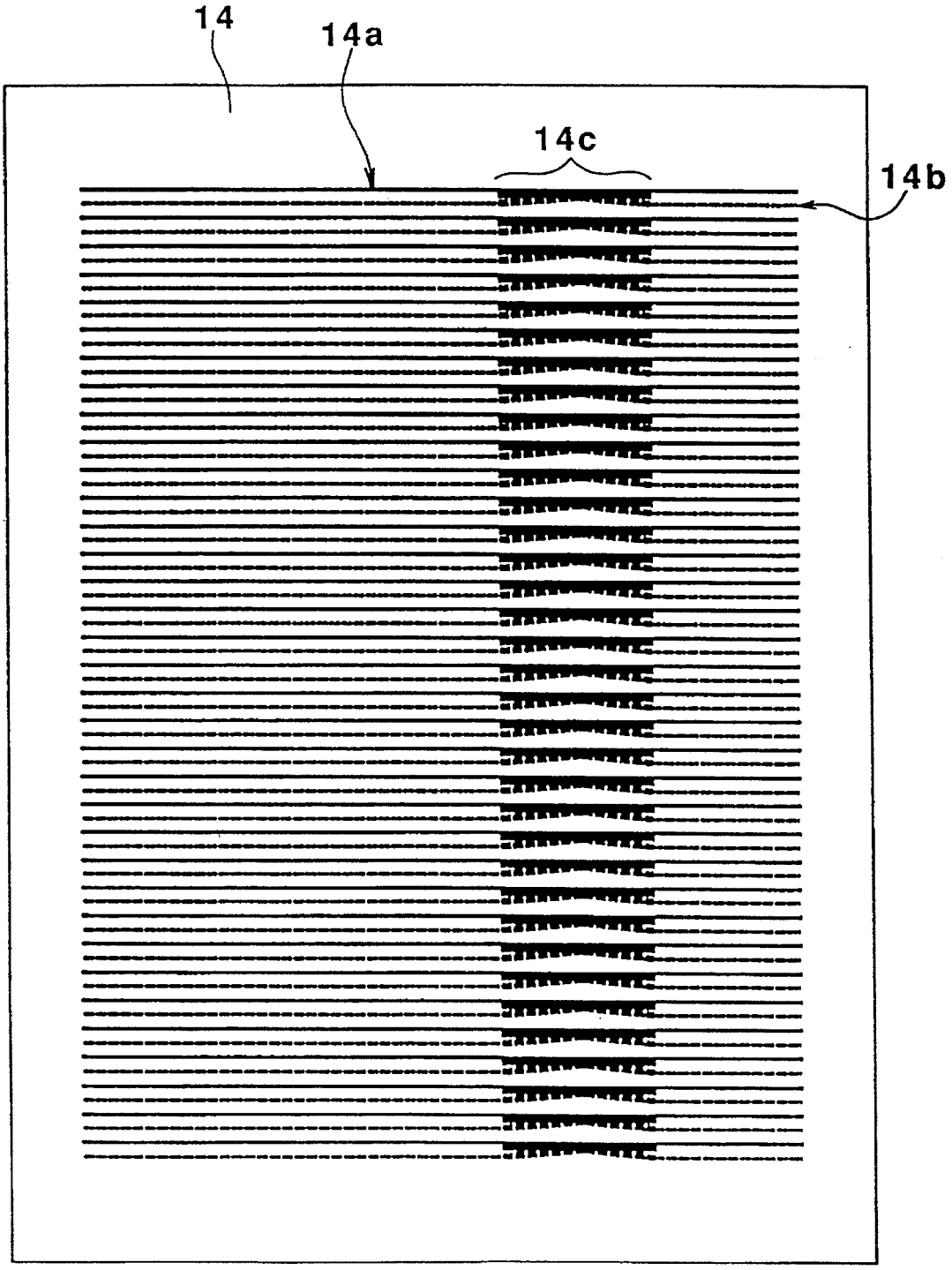
FIG.12 PRIOR ART
FIG. 12 is a diagram illustrating an example of interference fringes.

If there is a difference in the electrostatic capacity and the phase in the axial direction of charging roller 20 as described above, interference fringes 14*c* as shown in FIG. 12 appear.

As described above, both portions which are clearly developed and portions which are not clearly developed are present even though lines of the same line pitch are printed on one printed image. As a result, interference fringes become noticeable.

B. Optimum Frequency Range for Each Printing Density dpi

The point of generation of interference fringes can, for example, be obtained in the following manner. That is, the sum of the line width n and the interval m between lines in line scanning is represented by N (N (=n+m) times the minimum line pitch. In other words, N represents the number of dots per one period of a plurality of lines). The frequency of the primary charging power supply is represented by f (Hz), the process speed is represented by $V_p$ (mm/sec), and the printing density is represented by $D_{dpi}$. The point of generation of interference fringes can be obtained from the following expression:

$$f=V_p\times D_{dpi}\div(25.4\times N) \quad (2),$$

or $$f=V_p\times D_{dpi}\div(25.4\times 1/M) \quad (3),$$

where M represents the number (an integer) of cycles by charging per one period of a plurality of lines.

Expression (3) represents a case in which the number of dots per period equals 1 and the number of cycles per period equals M.

The number of dots per period indicates how many dots having a diameter d are present within one period from turning-on of the laser to the next turning-on of the laser.

When the point of generation of interference fringes is investigated in more detail, it is necessary to consider the case of higher order in which the number of dots per period equals N≧2, and the number of cycles per period equals at least 2.

In consideration of the above-described case, the frequency f of the primary power supply at which interference fringes appear is expressed as follows:

$$f=V_p\times D\div(25.4\times M/M) \quad (4),$$

where f is the frequency of the primary charging power supply, $V_p$ is the process speed, D is the printing density of the image, N is the number (an integer) of dots per period, and M is the number (an integer) of cycles per period.

Expression (2) represents a case in which the number M of cycles per period equals 1 and the number N of dots per period changes in expression (4). Expression (3) represents a case in which the number N of dots per period equals 1 and the number M of cycles per period changes in expression (4).

The oscillating voltage component (AC component) of power supply 4 is not limited to a sine-wave component, but the above-described expressions also hold for a triangular-wave component, a rectangular-wave component obtained by switching a DC voltage, and the like.

C. Cause of Generation of "Charging Tone"

Figure 14A:
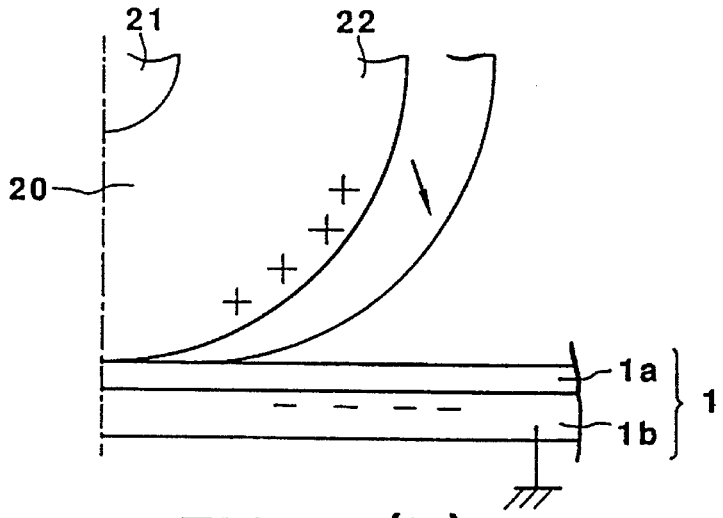
FIG.14(a) PRIOR ART
FIGS. 14(*a*) through 14(*c*) are diagrams illustrating the mechanism of generation of charging tone.
Figure 14B:
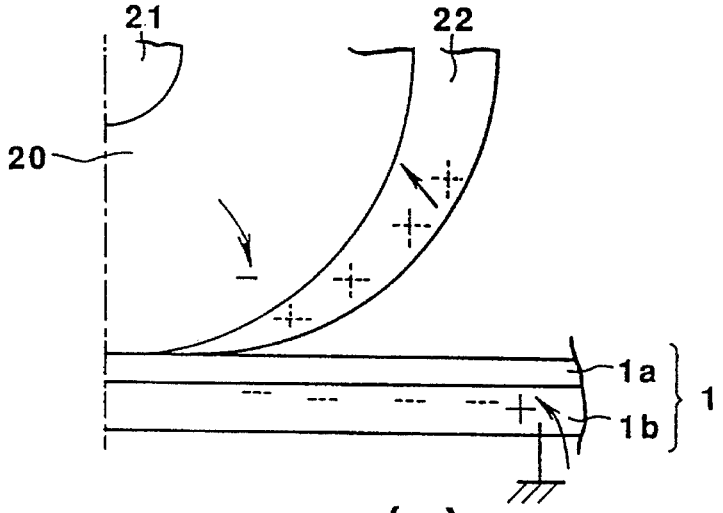
FIG.14(b) PRIOR ART
Figure 14C:
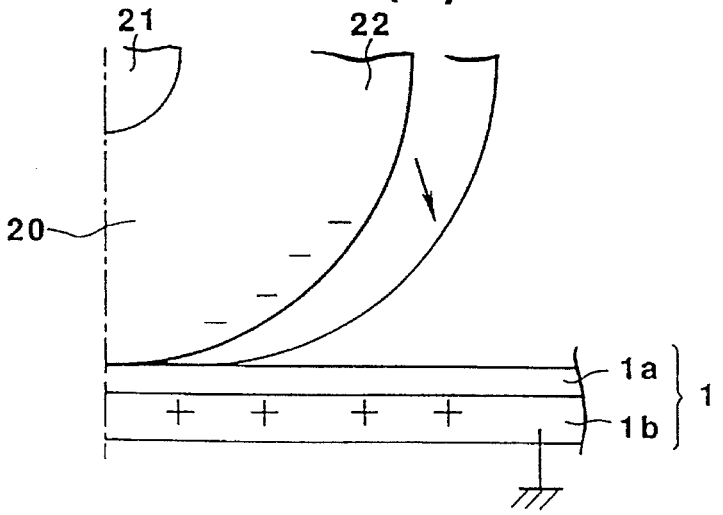
FIG.14(c) PRIOR ART

A description will now be provided of the mechanism of generation of charging tone with reference to the model diagrams shown in FIGS. 14(*a*) through 14(*c*).

In FIGS. 14(*a*) through 14(*c*), reference numeral 1 represents a photosensitive drum which serves as a member to be charged. Reference numeral 1*b* represents a grounded conductive base later (substrate) made of aluminum. Photosensitive later 1*a* is formed on the outer surface of base layer 1*b*. Charging roller 21 serves as a contact charging member in pressure contact with the surface of photosensitive drum 1. Reference numeral 21 represents a core metal. Reference numeral 22 represents a solid charging layer made of conductive rubber, such as EPDM (ethylene propylen dien monomer) in which carbon is dispersed, or the like.

(1) By the AC component of the applied oscillating voltage ($V_{ac}+V_{dc}$), positive electric charges are induced at charging layer 22 and negative electric charges are induced at base layer 1*b* across photosensitive layer 1*a* in charging member 20 at a certain moment, as indicated by a thick solid line shown in FIG. 14(*a*).

(2) Since these positive and negative electric charges attract each other, the surface of charging layer 22 is drawn to the side of photosensitive drum 1 against the elasticity of charging later 22, and moves from the position indicated by the thick solid line to the position indicated by a thin solid line (the position indicated by a thick solid line in the case of FIG. 14(*b*)).

(3) As the AC electric field then starts to be reversed, the positive electric charges at charging layer 22 and the negative electric charges at base layer 1*b* start to be cancelled by respective induced electric charges having opposite polarities.

When the AC electric field changes from a positive value to a negative value, the positive electric charges at charging layer 22 and the negative electric charges at base layer 1*b* disappear. FIG. 14(*b*) indicates such a state.

(4) As a result, the attracting force against the elasticity of charging layer 22 for the surface of charging layer 22 is released, whereby charging layer 22 returns from the position indicated by the thick solid line to the position indicated by a thin solid line shown in FIG. 14(*b*) (the position indicated by the thick solid line shown in FIG. 14(*a*)).

(5) When the AC electric field reaches the peak of negative values, negative electric charges are induced at charging layer 22 and positive electric charges are induced at base layer 1*b*, as shown in FIG. 14(*c*). As a result, by the attracting force between the negative and positive electric charges, the surface of charging layer 22 is attracted again toward photosensitive drum 1 against the elasticity of charging layer 22, and moves from the position indicated by the thick solid line to the position indicated by the thin solid line.

In accordance with repeated reversal between positive values and negative values of the AC electric field, the movement of the surface of charging layer 22 toward photosensitive drum 1 against the elasticity of charging layer 22 and the returning movement of the surface of charging layer 22 caused by the release of the attracting force are repeated. As a result, charging member 20 starts to vibrate in accordance with application of the oscillating voltage, causing generation of "charging tone".

As is apparent from the foregoing explanation, since charging member 20 vibrates twice during one period of the AC voltage, the following relationship holds between the frequency f of the AC component and the frequency F of oscillation of charging member 20:

$$2f(Hz)=F(c/s) \quad (5).$$

Charging tone is generated not only when the contact charging member comprises a charging roller, but also in the case of a charging blade, a charging pad or the like with the same mechanism.

In a conventional image forming apparatus, a bias voltage having an AC component of 2.0 $KV_{pp}$/600 Hz was applied to charging member 20. The apparatus was placed in an anechoic room, and charging tone was measured. The level of the measured charging tone was 55 dB. This value is greater than the value of 50 dB obtained in the case of corona discharge. Accordingly, the following countermeasures for reducing the charging tone were investigated.

1) The frequency of the applied AC component was reduced. If the frequency was reduced to 300 Hz or less, the charging tone was considerably improved. However, in an apparatus having high process speed, a cycle pattern became noticeable, and interference fringes also increased.

2) The peak-to-peak voltage $V_{pp}$ of the applied AC component was reduced less than twice the charging start voltage. In such a case, the charging tone was considerably reduced. However, it was impossible to provide uniform charging on the photosensitive drum, and spotted unevenness in charging appeared.

3) In order to reduce the charging tone, a damping material made of rubber or the like was inserted within the photosensitive drum. This approach, however, has problems in deformation of the photosensitive drum, an increase in the weight of the apparatus, and an increase in the production cost.

In the present invention, in a charging unit of the AC application method, an image forming apparatus or a process cartridge which uses the charging unit, the cycle pattern is less noticeable, the applied frequency can be reduced, and it is possible to suppress charging tone and image interference fringes in the image forming apparatus to a level of no importance.

Preferred embodiments of the present invention will now be described with reference to the drawings.

Figure 1:
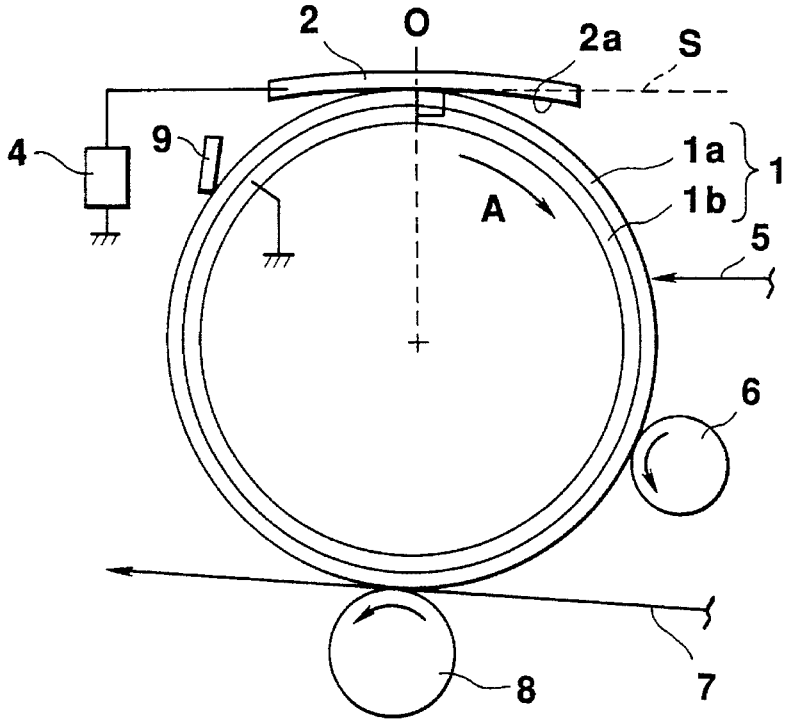
FIG. 1 is a diagram showing the schematic configuration of an image forming apparatus according to a first embodiment of the present invention.

FIG. 1 is a diagram showing the schematic configuration of an image forming apparatus according to a first embodiment of the present invention. The image forming apparatus of the present embodiment comprises an electrophotographic laser-beam printer which uses a contact charging unit as charging means for an image bearing member.

Rotating-drum-type electrophotographic photosensitive member (photosensitive drum) 1, serving as an image bearing member, comprises organic photoconductive (opc) layer 1*a* having negative charging polarity, serving as a photosensitive layer, formed on the outer circumferential surface of drum base member 1*b* made of aluminum whose outer diameter is 30 mm, and is rotatably driven in a clockwise direction indicated by arrow A with a predetermined process speed (circumferential speed) $V_{ps}$.

Reference numeral 2 represents an electrode plate, serving as a charming member, made of a metal, conductive plastic, conductive rubber, or the like.

Reference numeral 4 represents a power supply for applying a voltage to charging member 2. Power supply 4 applies an oscillating voltage ($V_{ac}+V_{dc}$), which comprises a superposed voltage of AC component $V_{ac}$ having peak-to-peak voltage $V_{pp}$ equal to at least twice the charming start voltage for photosensitive drum 1, and DC component $V_{dc}$ (a voltage corresponding to the target charging potential), to charging member 2, whereby the outer circumferential surface of the rotatably driven photosensitive drum 1 is subjected to uniform contact charging by the AC application method.

On the other hand, a time-serial electrical digital pixel (picture element) signal of target image (printing) information is input from a host apparatus (not shown), such as a computer, a word processor, an image reading apparatus or the like, to a laser scanner (not shown). The laser scanner controlled by a controller outputs laser light 5 subjected to image modulation with a constant printing density $D_{dpi}$ in accordance with the input pixel signal. By performing line scanning (main-scanning exposure in the direction of the generatrix of the drum) of the output laser light 5 for the charged surface of the rotating photosensitive drum 1, the target image information is written to form an electrostatic latent image of the image information on the surface of the rotating photosensitive drum 1.

The latent image is visualized as a toner image by performing reversal development with toner having the same polarity as the charging polarity of the charging member using developing sleeve 6 of a developing unit. The toner image is sequentially transferred onto transfer material fed from a sheet-feeding unit (not shown) to a pressure-contact nip portion (transfer portion) between photosensitive drum 1 and transfer roller 8 with a predetermined timing.

Transfer material 7 onto which the toner image has been transferred is separated from the surface of photosensitive drum 1 and conveyed to fixing means (not shown), where the toner image is fixed. Transfer material 7 on which the toner image has been fixed is output as an image-formed material. The surface of the rotating photosensitive drum 1 after separating transfer material 7 is cleaned by removing any remaining deposit, such as remaining toner after transfer, or the like, using cleaning blade 9 of a cleaner, and is repeatedly used for image formation.

Next, a description will be provided of electrode plate 2, serving as the charging member, shown in FIG. 1.

As described above, in contact charging, the charging member need not always contact a member to be charged, and may not contact the member to be charged, provided that a chargeable region determined by a gap voltage vg(x,n) and a correction Paschen curve vp(x) can be secured. When the charging member is provided in the proximity of the member to be charged, it is preferred that the gap between the charging member and the member to be charged is 5 μm–1000 μm.

In the present embodiment, electrode plate 2, serving as the charging member, contacts the surface of photosensitive drum 1 in a circularly curved state so that its charging surface 2*a* is at the side of the surface of photosensitive drum 1 with respect to tangent S drawn from position O where photosensitive drum 1 contacts electrode plate 2 toward the downstream side in the moving direction of photosensitive drum 1.

Peak-to-Peak Voltage of the Cycle Pattern

As described above with reference to FIG. 12, in the case of contact charging of the AC application method, cycle pattern 14*b* caused by the frequency of the primary charging power supply appears, causing interference fringes 14*c*. The peak-to-peak voltage of the cycle pattern is obtained in the following procedure.

(1) Gap distance z(x) and position x on the drum

Figure 2:
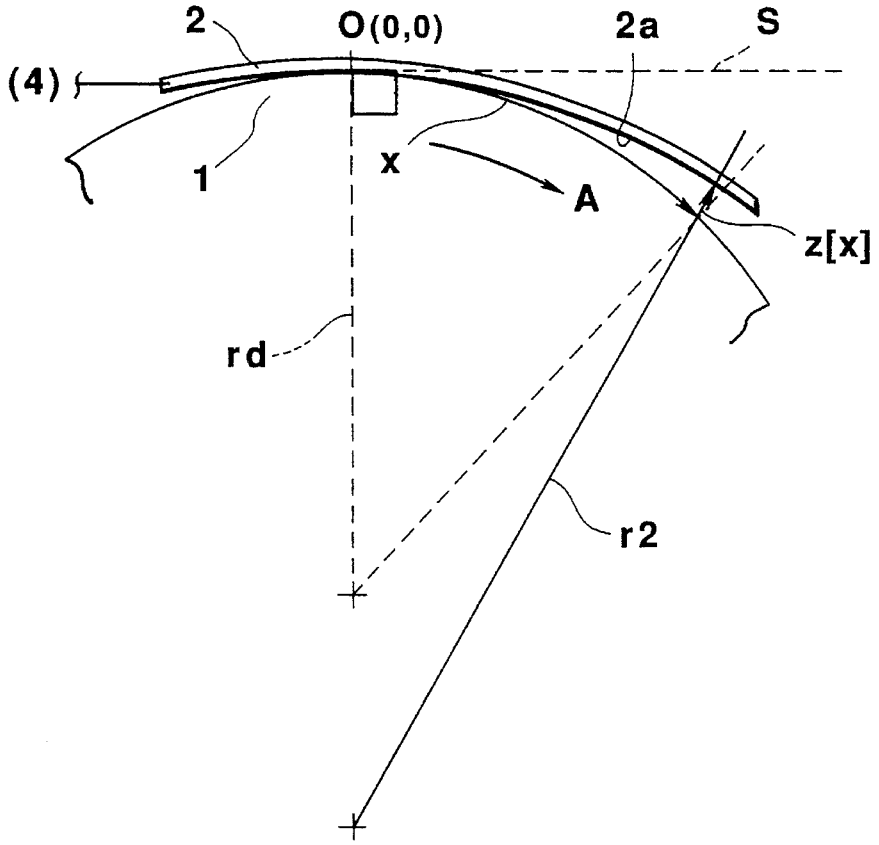
FIG. 2 is a diagram showing an enlarged principal portion of a charging unit of the apparatus.

As shown in FIG. 2, the contact point between photosensitive drum 1 and charging member 2 is represented by O(0,0), and the distance between photosensitive drum 1 and the surface of charging member 2 at a point on photosensitive drum 1 downstream by x mm is represented by z(x). The radius of photosensitive drum 1 is represented by rd.

It is assumed that the cross section of charging member 2 in its axial direction has the shape of an arc of a circle having a radius r2 (r2=19 mm in the present embodiment) whose center is on the line extended from the line obtained by connecting the contact point O between charging member 2 and photosensitive drum 1 to the central point of photosensitive drum 1.

Figure 3:
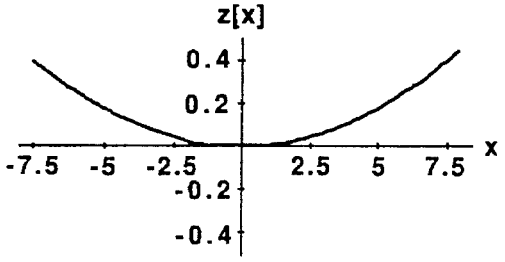
FIGS. 3(1) through 3(8) are graphs illustrating various factors in the vicinity of a charging member of the apparatus.
Figure 3:
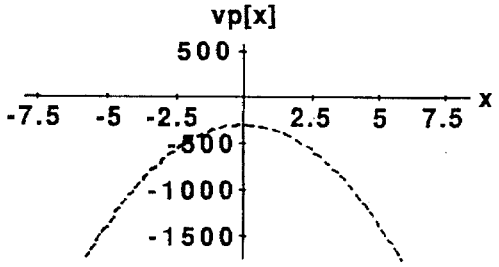
Figure 3:
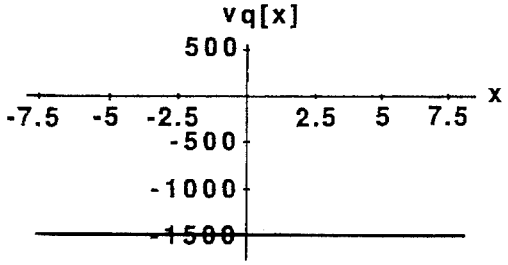
Figure 3:
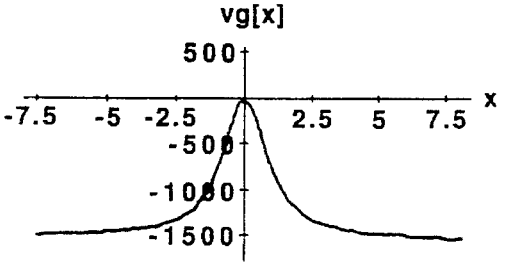
Figure 3:
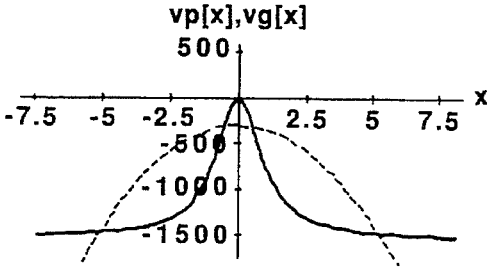
Figure 3:
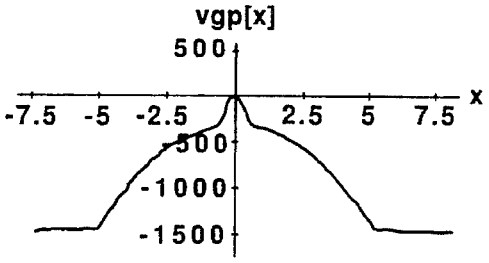
Figure 3:
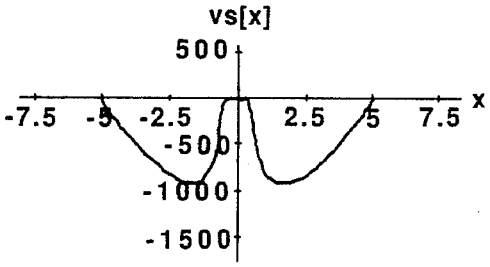
Figure 3:
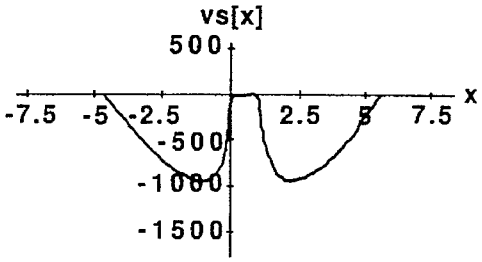

Then the following relationship holds between z(x) and x. FIG. 3(1) illustrates the relationship. In FIG. 3(1), the ordinate represents z(x) and the abscissa represents x, both expressed in units of mm.

$$z(x)=r2-|rd\times exp(xi/rd)-(rd-r2)| \quad (6),$$

where rd represents the radius (15 mm) of photosensitive drum 1.

(2) Correction Paschen curve vp(x)

FIG. 3(2) shows the correction Paschen curve at point x on photosensitive drum 1. In FIG. 3(2), the ordinate represents the discharge start voltage vp(x)(V), and the abscissa represents x.

$$vp(x)=312+6200\ z(x) \quad (7).$$

(3) Applied voltage vq(t, n)

A case in which a pulsed bias voltage of −1500 V is applied to charging member 2 will be considered.

In FIG. 3(3), the ordinate represents the applied voltage vq(t, n)=−1500 V, and the abscissa represents x.

(4) Gap voltage vg(x, n) (V)

Gap voltage vg(x, n) between charging member 2 and photosensitive drum 1 at point x on photosensitive drum 1 can be expressed as follows:

$$vg(x, n)=\{vq(t, n)-vs(x-vps\times t, n-1)\}/\{L/(ez(x)+1\} \quad (8),$$

where vs is the surface potential of photosensitive drum 1, vps is the process speed of photosensitive drum 1, L is the thickness of the photosensitive layer, t is the interval of sampling which equals ¼ f (¼ of one period), e is relative dielectric constant, and n is the number of sampling operations.

Some typical gap voltages are selected and plotted (with performing sampling). Sampling is performed for every ¼ period of the gap voltage. Since the frequency of the primary charging bias voltage is sufficiently large compared with the process speed, changes in the surface potential of photosensitive drum 1 can be sufficiently followed with the above-described interval of sampling. In the present embodiment, vps=12 πmm/s, L=20 μm, and e=3.0.

It is assumed that in vs(x−vps×t, n−1), vs=0 when n=1, that is, the surface potential of photosensitive drum 1 is zero at the initial stage. FIG. 3(4) illustrates the gap voltage.

(5) Gap voltage vgp(x, n) (V) after discharging

FIG. 3(5) illustrates both the gap voltage vg(x, n) and the correction Paschen curve vp(x) (indicated by a broken line). In FIG. 3(5), the ordinate represents both vg(x, n) and vp(x), and the abscissa represents x.

In FIG. 3(5), when the absolute value of the gap voltage age vg(x, n) is greater than the absolute value of the correcion Paschen curve vp(x), discharge occurs at that region. Then the value of the gap voltage vg(x, n) decreases to the value of the correction Paschen curve vp(x). This value is termed a gap voltage vgp(x, n) after discharge. FIG. 3(6) illustrates the gap voltage after discharge. In FIG. 3(6), the ordinate represents vgp(x, n), and the abscissa represents x.

$$1)\ |vg(x, n)| \leqq vp(x) \rightarrow vgp(x, n) = vg(x, n) \quad (9)$$

$$2)\ vg(x, n) > 0 \quad vg(x, n) > vp(x) \rightarrow vgp(x, n) = vp(x) \quad (10)$$

$$3)\ vg(x, n) \leqq 0 \quad vg(x, n) < -vp(x) \rightarrow vgp(x, n) = vp(x) \quad (11)$$

(6) Surface potential vs(x, n) (V) on the photosensitive drum

If the gap voltage vgp(x, n) after discharge is obtained, the surface potential vs(x, n) on the photosensitive drum can be obtained using the expression for the gap voltage vg(x, n).

$$vs(x, n)=vq(t, n)-vgp(x, n)/\{1/(L/ez(x)+1)\} \quad (12).$$

FIG. 3(7) illustrates the surface potential rs(x, n) on the photosensitive drum. In FIG. 3(7), the ordinate represents vs(x, n), and the abscissa represents x.

(7) Surface potential vs(x−vps×t, n) (V) on the photosensitive drum after t seconds After t seconds, the surface potential provided on the photosensitive drum moves from the state shown in FIG. 3(7) to the right due to the rotation of the photosensitive drum.

FIG. 3(8) illustrates the surface potential vs(x−vps×t, n) on the photosensitive drum at that time. In FIG. 3(8), the ordinate represents vs(x−vps×t, n), and the abscissa represents x. The moving direction in the x direction equals vps×t.

(8) When the applied voltage vq(t, n) (V) is an AC voltage

The AC bias voltage applied to the charging member is expressed as follows:

$$vq(t, n)=½\times vpp\ sin\ (2\ \pi ft(n-1)+dc \quad (13),$$

where vpp is the peak-to-peak voltage of the applied bias voltage, f is the frequency of the applied bias voltage, t is ¼ f, that is, ¼ of one period, n is the number of sampling operations, and dc is the DC component.

Figure 4:
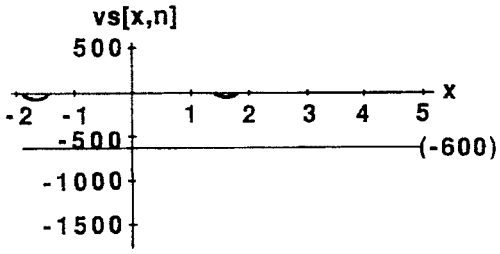
FIGS. 4(1) through 4(7) are graphs illustrating changes in the surface potential on a photosensitive drum of the apparatus.
Figure 4:
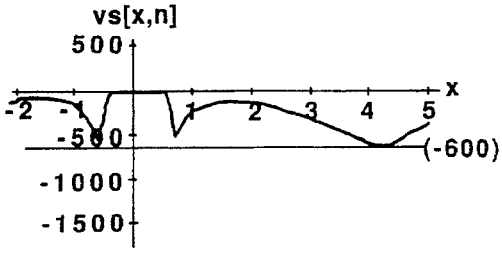
Figure 4:
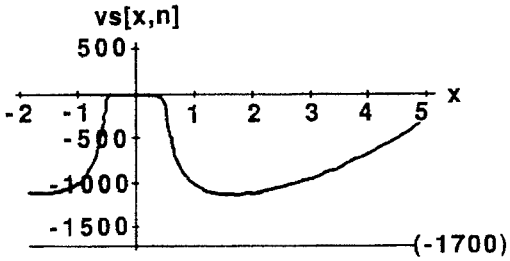
Figure 4:
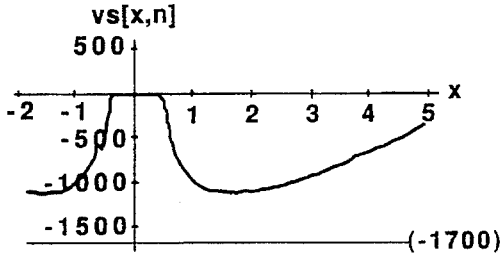
Figure 4:
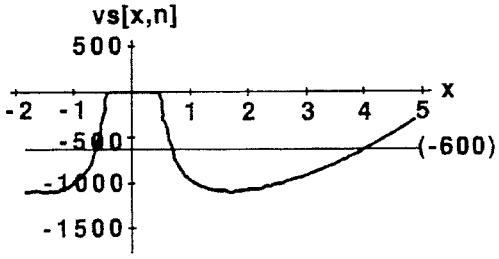
Figure 4:
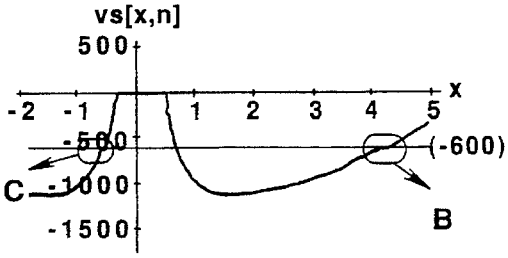
Figure 4:
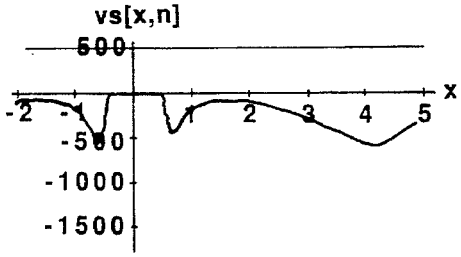

FIG. 4(1) illustrates a case in which vpp is 2200 V, f is 350 Hz, n is 1, and dc is −600 V.

A pulsed bias voltage having a period of ¼ f is substituted for the applied voltage, since the frequency of the primary bias voltage is sufficiently large compared with the process speed, and therefore changes in the surface voltage of the photosensitive drum can be sufficiently followed. In FIG. 4(1), the ordinate represents the applied voltage, and the abscissa represents x.

(9) Results of simulation when n=7

FIGS. 4(1) through 4(7) illustrate results of simulation of the surface potential vs(x, n) on the photosensitive drum and the voltage applied to the charging member when n changes from 1 to 7.

In FIGS. 4(1) through 4(7), the ordinate represents the surface potential vs(x, n) (V) on the photosensitive drum, and the abscissa represents x (mm).

In FIG. 4(1) representing the case of n=1, the voltage applied from the charging member to the surface of the photosensitive drum is −600 V. Accordingly, the surface of the photosensitive drum is charged to a surface potential of only several tens of volts.

In FIG. 4(2) representing the case of n=2, the applied voltage is −1700 V after t seconds, and a wide region on the photosensitive drum is charged.

In FIG. 4(3) representing the case of n=3, the applied voltage returns to −600 V after an additional t seconds. At that time, the gap voltage provided by the applied voltage and the surface potential of the photosensitive drum does not exceed the discharge start voltage expressed by expression (7) at any point. Accordingly, the surface potential on the photosensitive drum does not change, and only moves to the right in accordance with the process speed.

In FIG. 4(4) representing the case of n=4, the applied voltage becomes +500 V after an additional t seconds. At that time, the gap voltage provided by the applied voltage and the surface potential of the photosensitive drum exceeds the discharge start voltage at some portions. As a result, the surface potential on the photosensitive drum changes, and moves to the right in accordance with the process speed.

In FIG. 4(5) representing the case of n=5, the applied voltage returns to −600 V after an additional t seconds. At that time, the gap voltage provided by the applied voltage and the surface potential of the photosensitive drum does not exceed the discharge start voltage at any point. Accordingly, the surface potential on the photosensitive drum does not change, and only moves to the right in accordance with the process speed.

In FIG. 4(6) representing the case of n=6, the applied voltage becomes −1700 V after an additional t seconds. At that time, the gap voltage provided by the applied voltage and the surface potential of the photosensitive drum exceeeds the discharge start voltage at some portions. As a result, the surface potential on the photosensitive drum changes, and moves to the right in accordance with the process speed.

In FIG. 3(7) representing the case of n=7, the applied voltage returns to −600 V after an additional t seconds. At that time, the gap voltage provided by the applied voltage and the surface potential of the photosensitive drum does not exceed the discharge start voltage at any point. Accordingly, the surface potential of the photosensitive drum does not change, and only moves to the right in accordance with the process speed.

Figure 5:
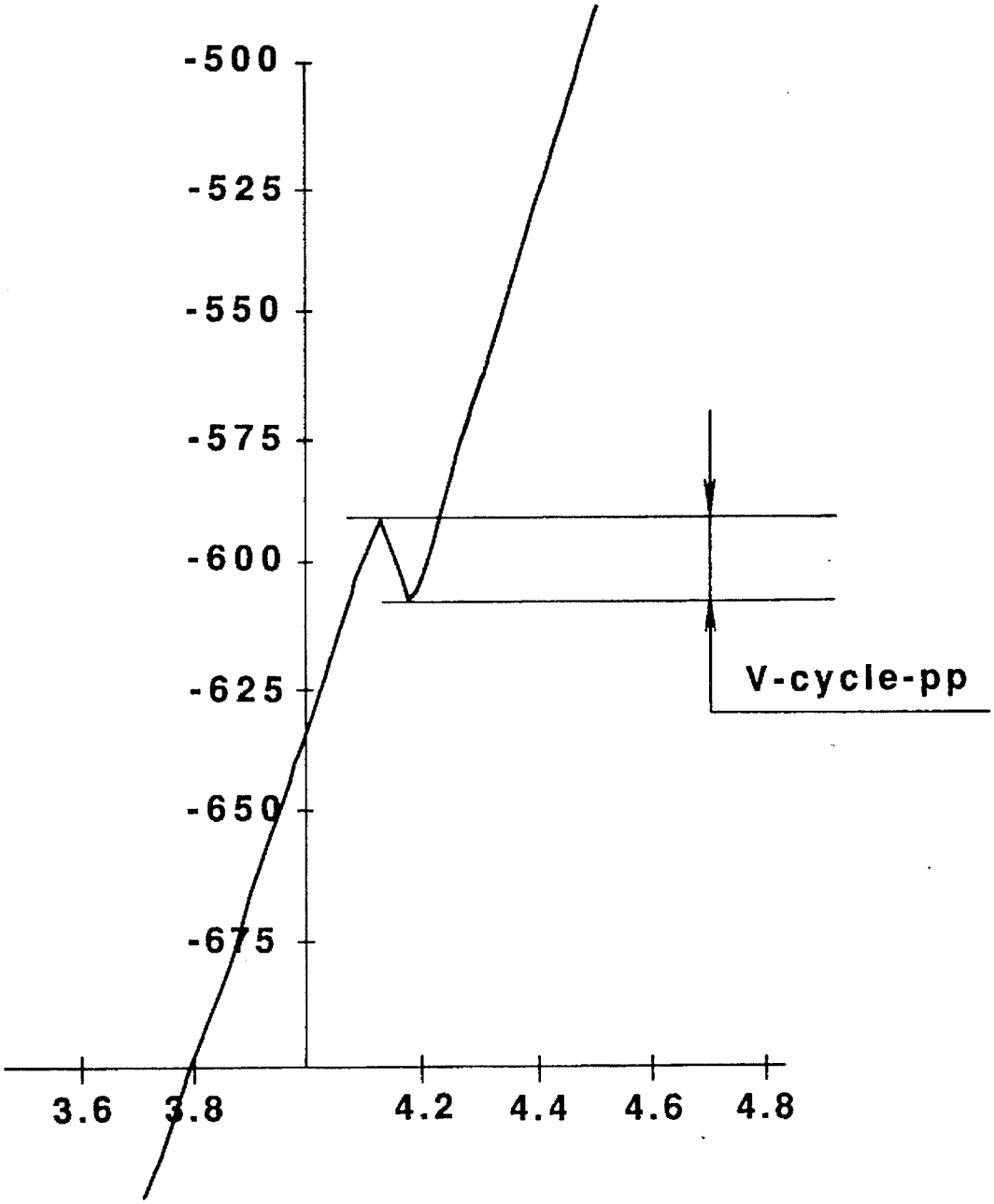
FIG. 5 is an enlarged graph of portion B of FIG. 4(7)

Portions B and C indicated in FIG. 4(7) correspond to the peak-to-peak voltage of the cycle pattern of charging. FIG. 5 is an enlarged graph of portion B. In FIG. 5, the ordinate represents the surface potential of the photosensitive drum, and the abscissa represents x. In the present embodiment, the peak-to-peak voltage (V-cycle-pp) equals 19.3 V.

As is apparent from FIG. 4(7), the peak-to-peak voltage of the cycle pattern is greater when the surface potential of photosensitive drum 1 moves toward contact point O between charging member 2 and photosensitive drum 1, as indicated by C, than when the surface potential of photosensitive drum 1 leaves from contact point O, as indicated by B. Accordingly, it is necessary to reduce the peak-to-peak voltage of the cycle pattern at the most downstream side of charging surface 2*a* by arranging charging member 2 so that charging surface 2*a* at the downstream side from contact point O is inside tangent S and gradually leaves photosensitive drum 1.

Figure 10:
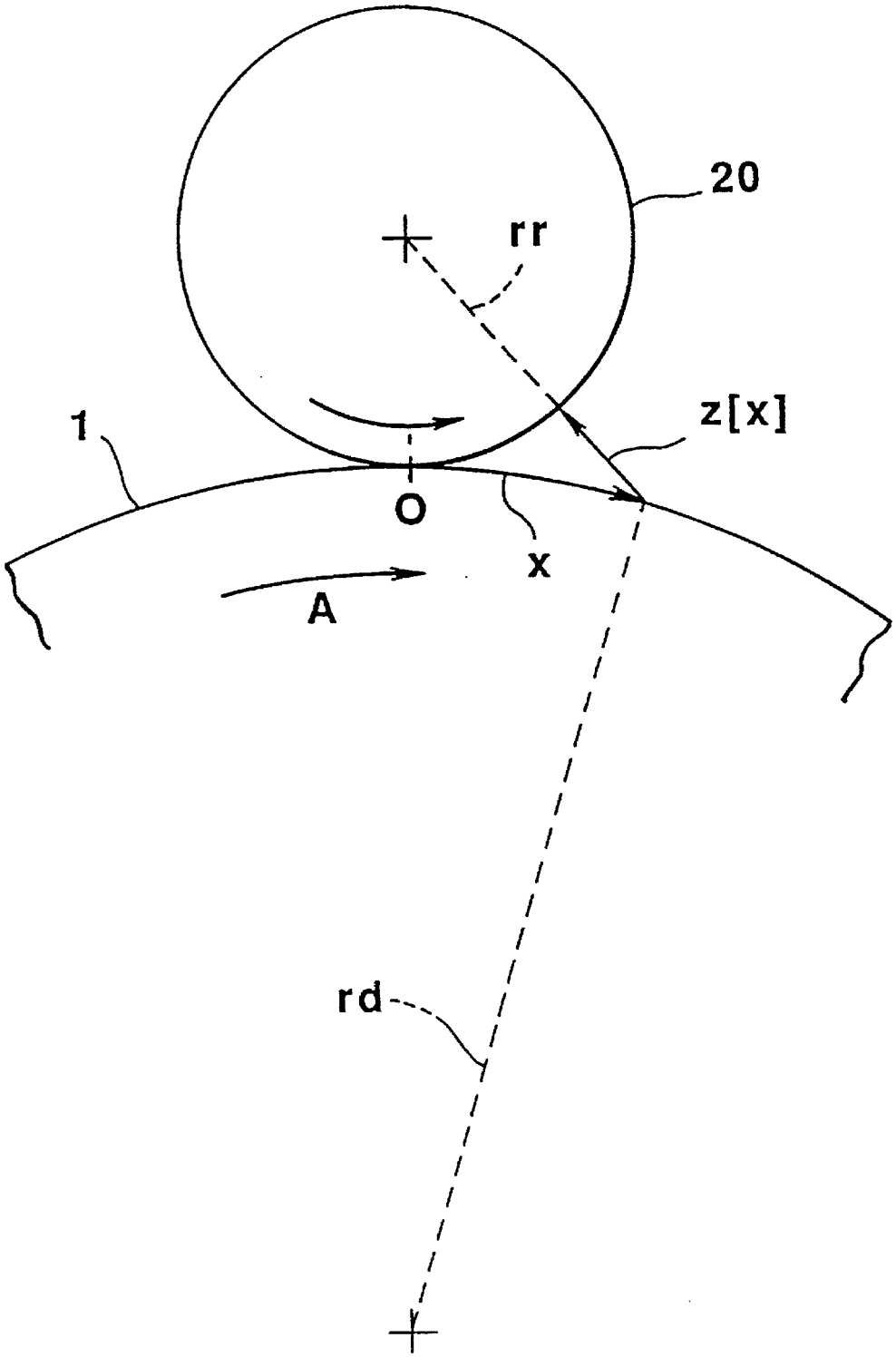
FIG.10 PRIOR ART
FIG. 10 is a diagram illustrating the relationship between x and z(x) when the charging member comprises a charging roller.
Figure 11:
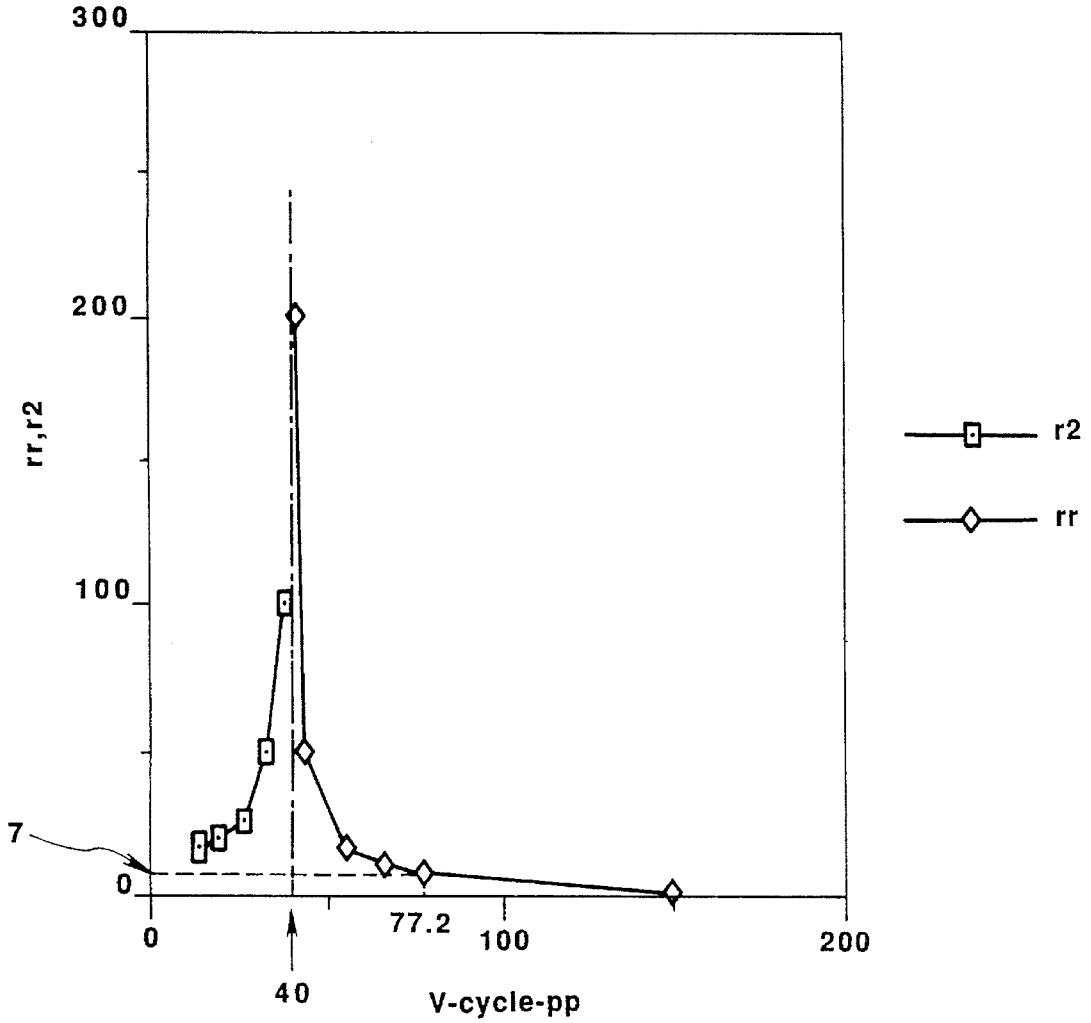
FIG. 11 is a diagram illustrating the relationship between the curvature of the charging member and V-cycle-pp.

It becomes clear from this simulation that when charging is performed by the conventional charging roller 20, the peak-to-peak voltage is as large as 77.2 V when radius rr of the charging roller equals 7 mm, as shown in the graph of FIG. 11. In this case, as shown in FIG. 10, gap distance z(x) corresponds to the distance from point x on photosensitive drum 1 to the nearest point on the surface of the charging roller.

$$z(x)=|rd\times exp(xi/rd)-(rd+rr)|-rr \quad (14),$$

where rr is the radius of the charging roller.

In the graph of FIG. 11, the ordinate represents radius rr of charging roller 20 and radius r2 of the charging plate (see FIG. 2), and the abscissa represents the peak-to-peak voltage (V-cycle-pp) of the cycle pattern of charging. As is apparent from this graph, when the charging surface of charging roller 20 is outside the tangent of photosensitive drum 1, the peak-to-peak voltage will not be less than a certain value (about 40 V in the present case) no matter how the radius of the charging roller is increased. On the other hand, when the charging surface of charging member 2 at the downstream side from the contact position between the charging plate and the photosensitive drum is inside the tangent of photosensitive drum 1, the peak-to-peak voltage decreases as the value of radius r2 is reduced. In the present embodiment, the peak-to-peak voltage could be reduced to as small as about 14 V.

In image output in the above-described system, the cycle pattern completely disappeared even in a halftone image, and excellent images free from the memory effect of the photosensitive drum were obtained.

In the foregoing explanation, for the convenience of explanation, a case in which the charging plate contacts the photosensitive drum has been described. However, the same conclusion holds also when the charging plate is in the proximity of the photosensitive drum with a minute gap.

According to the present embodiment, by arranging a charging member so that the charging surface of the charging member is at the side of a member to be charged from the tangent drawn from the contact position or the position on the charging member at the nearest position between the charging member and the member to be charged, the peak-to-peak voltage of the cycle pattern is reduced. As a result, it becomes possible to suppress interference fringes and charging tone to a level of no importance.

The fact that the peak-to-peak voltage of the cycle pattern can be reduced indicates that the frequency of the applied voltage can be reduced at the same process speed. As a result, charging tone can also be reduced.

The apparatus shown in FIG. 1 was placed in an anechoic room, and noise in the above-described conditions was measured conforming to paragraph 6 of ISO (International Organization for Standardization) 7779. The result of the measurement indicates that the noise level close to 55 dB obtained in the case of the conventional approach was reduced to as small as 33 dB. In addition, interference fringes in output images were not noticeable at all.

Figure 6:
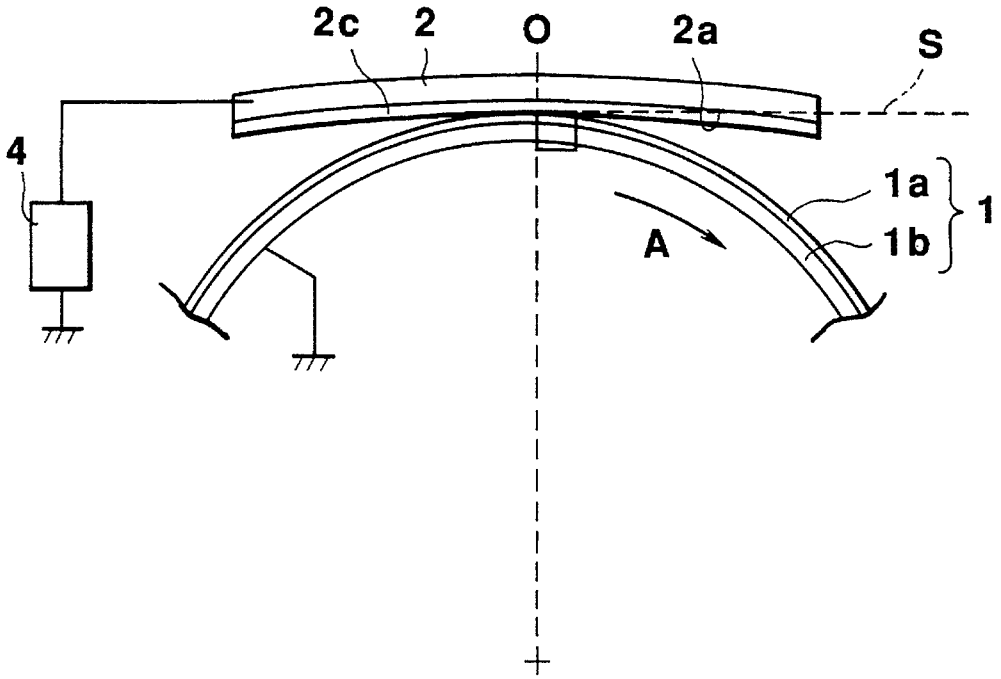
FIG. 6 is a diagram showing the schematic configuration of a principal portion of a charging member according to a second embodiment of the present invention.

FIG. 6 is a diagram showing the configuration of a charging member according to a second embodiment of the present invention.

A protective layer may be provided on the surface of the charging member in order that, for example, abnormal discharge, such as current leakage or the like, from the charging member does not occur in a defective portion, such as a pinhole or the like, which may be present on the surface face of a member to be charged.

In the present embodiment, a high-resistance layer 2*c* made of epichlorohydrin rubber, tolidine or the like, is provided on the surface of electrode plate 2, serving as the charging member, shown in FIG. 1, facing photosensitive drum 1. The same effect may, of course, be obtained using such a charging member 2.

Figure 7:
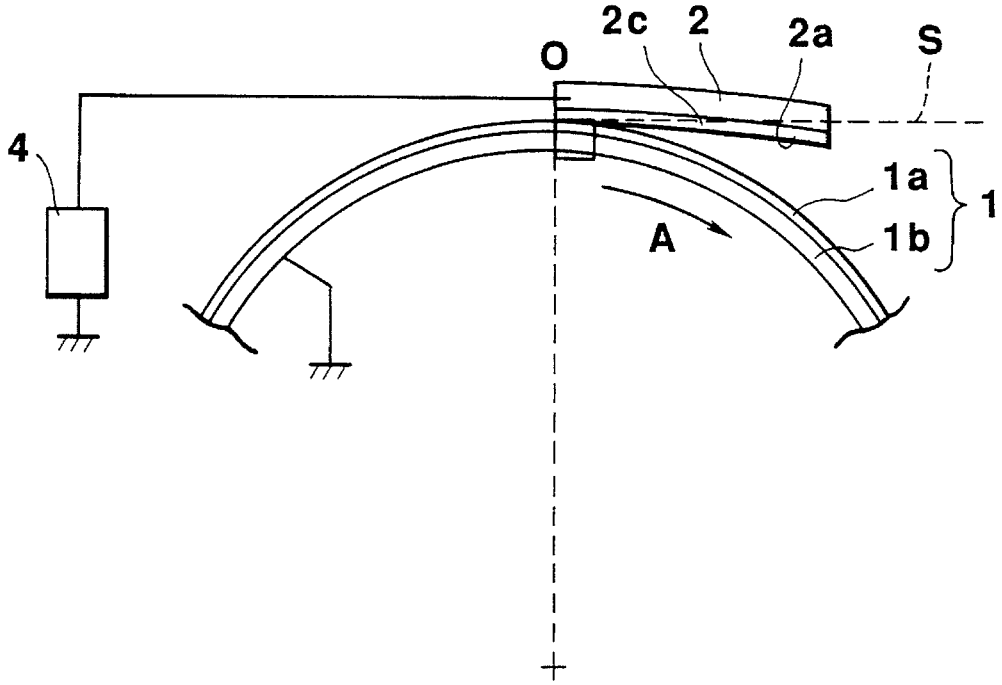
FIG. 7 is a diagram showing the schematic configuration of a principal portion of a charging member according to a third embodiment of the present invention.

FIG. 7 is a diagram showing the configuration of charging member according to a third embodiment of the present invention.

In the present embodiment, in comparison with the charging member shown in FIG. 1, the charging member is provided only at the downstream side from the closest point or the contact point between photosensitive drum 1 and charging member 2.

In this case, it is possible to make charging member 2 very compact. Although the effect of averaging the surface potential on the photosensitive drum is halved, this disadvantage will be overcome by increasing the frequency of the charging bias voltage, or increasing the charged region by increasing the width of the charging member.

Figure 8:
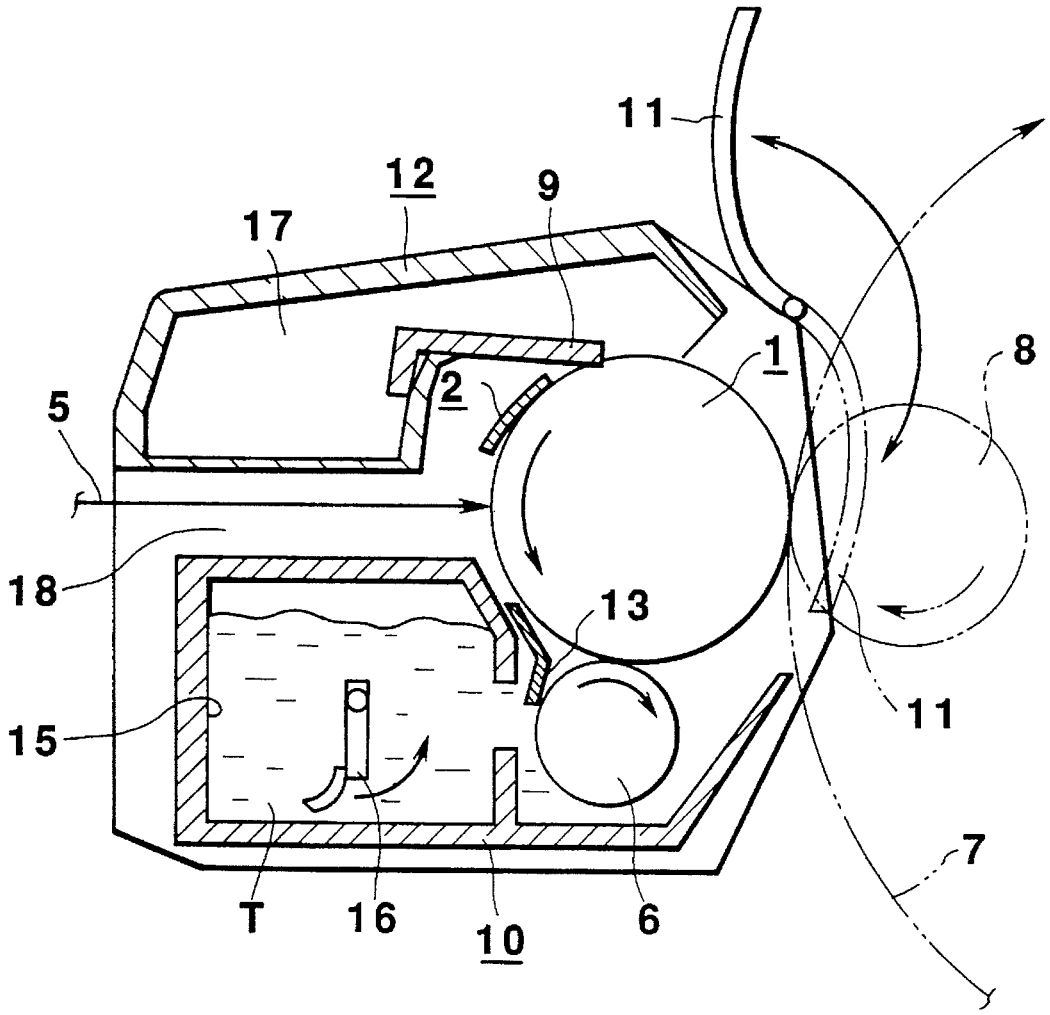
FIG. 8 is a diagram showing the schematic configuration of a process cartridge incluing a charging member.

FIG. 8 is a diagram showing the configuration of a process cartridge of an image forming apparatus in which a charging unit is used as charging means for an image bearing member.

The process cartridge of the present embodiment includes four process units, i.e., rotating-drum-type electrophotographic photosensitive member 1, serving as an image bearing member, charging plate 2, serving as a charging member, developing unit 10, and cleaning unit 12.

Charging plate 2, serving as the charging member, has the same configuration as in the above-described embodiment.

Developing unit 10 includes developing sleeve 6, receptacle 15 for developer (toner) T, and toner-stirring rotating member 16 provided within receptacle 15, which has the function of stirring toner T and feeding it in the direction of developing sleeve 6. Developing blade 13 has the function of coating toner T on developing sleeve 6 with a uniform thickness.

Cleaning unit 12 includes cleaning blade 9, and toner reservoir 17 for storing toner collected by cleaning blade 9.

Drum shutter 11 of the process cartridge is openable and closable between an opened state indicated by solid lines and a closed state indicated by two-dot chain lines. When the process cartridge is taken out from the main body of the image forming apparatus (not shown), drum shutter 11 is in the closed state indicated by the two-dot chain lines so as to protect the surface of photosensitive drum 1 by covering the portion of the surface of photosensitive drum 1 exposed to the outside.

When mounting the process cartridge in the main body of the image forming apparatus, shutter 11 is made to be in the opened state indicated by the solid lines. Alternatively, shutter 11 is automatically opened when the process cartridge is mounted. After the process cartridge has been mounted in a normal state, the portion of the surface of photosensitive drum 1 exposed to the outside is in pressure contact with transfer roller 8.

The process cartridge and the main body of the image forming apparatus are coupled mechanically and electrically so that photosensitive drum 1, developing sleeve 6, stirring bar 16 and the like in the process cartridge can be driven by a driving mechanism provided in the image forming apparatus, and, for example, a charging bias voltage and a developing bias voltage can be applied to charging plate 2 and developing sleeve 6 in the process cartridge, respectively, by electrical circuitry provided in the main body of the image forming apparatus. Thus, image forming processing can be executed.

Path 18 for exposure is provided between cleaning unit 12 and developing unit 10 in the process cartridge. Laser light 5 output from a laser scanner (not shown) provided in the main body of the image forming apparatus is projected within the process cartridge through path 18 for exposure, whereby the surface of photosensitive drum 1 is subjected to scanning exposure.

According to such a configuration, it is possible to provide a process cartridge in which the peak-to-peak voltage of the cycle pattern is very small, and therefore a print substantially free from interference fringes can be obtained.

In the above-described embodiment, a description has been provided of the case in which the charging member contacts the member to be charged at one point in the moving direction of the member to be charged. However, when a charging member contacts a member to be charged with a certain width in the moving direction of the member to be charged, interference fringes can, be prevented by providing the charging surface of the charging member at the same side as the member to be charged with respect to the tangent drawn from the most downstream point of the contact portion between the charging member and the member to be charged toward the downstream side in the moving direction of the member to be charged. In p1ace of providing a region where a charging member contacts a member to be charged, a region where the charging member is in the proximity of the member to be charged may be provided.

Next, a description will be provided of a fourth embodiment of the present invention in which a charging member having a shape different from that of the above-described charging member is provided.

Figure 15:
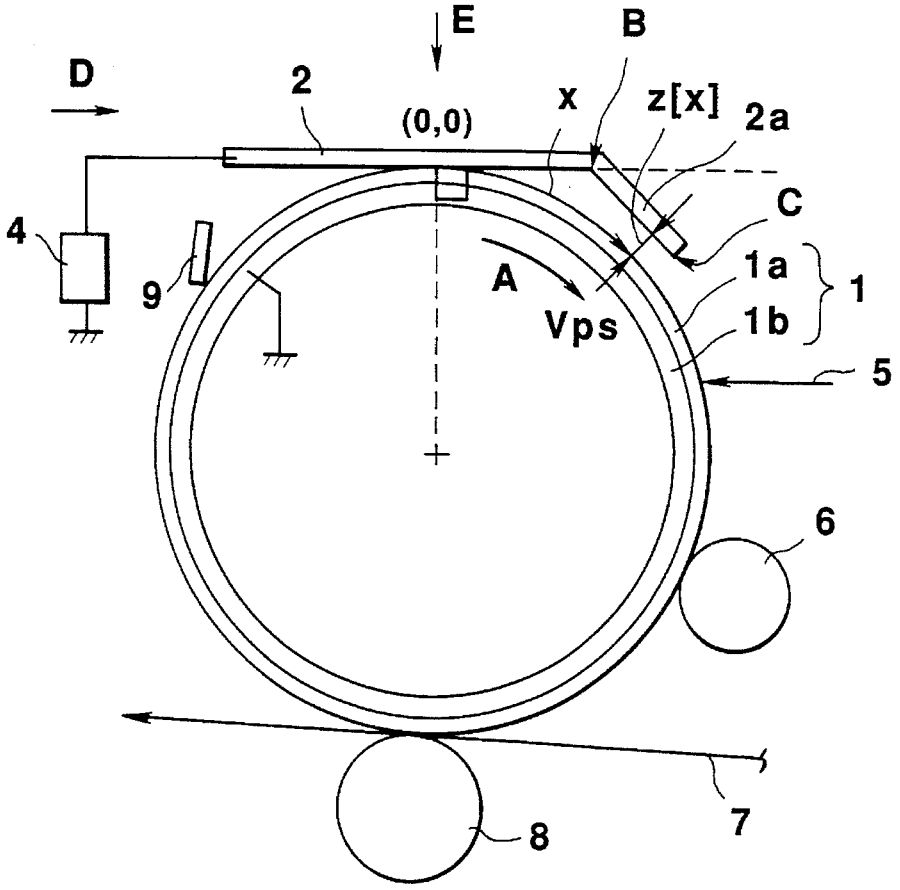
FIG. 15 is a diagram showing the schematic configuration of an image forming apparatus including a charging member according to a fourth embodiment of the present invention.

In the present embodiment, as shown in FIG. 15, charging member 2 is disposed in the proximity of photosensitive drum 1 with a gap of about 20 μm. By applying an oscillating voltage ($V_{ac}+V_{dc}$) from power supply 4 to charging member 2, the rotating photosensitive drum 1 is charged by the AC application method.

A portion of charging member 2 downstream in the direction of rotation of photosensitive drum 1 is bent toward the surface of photosensitive drum 1 at position B with a gradient of −0.375. Portion beyond position B facing photosensitive drum 1 is substantially parallel to the surface of photosensitive drum 1 with a width of about 3.2 mm. Charging member 2 is closest to photosensitive drum 1 at the position of origin (0, 0). The distance from the position of origin (0, 0) to the bent position B is about 3 mm. It is desirable that the distance between parallel portion 2*a* and photosensitive drum 1 is 5 μm–1000 μm.

(1) Gap distance z(x) and position x on the drum

As shown in FIG. 15, the closest point between photosensitive drum 1 and charging member 2 on the surface of photosensitive drum 1 is represented by (0, 0), and the shortest distance between a point on photosensitive drum 1 separated by x mm from that point in the downstream direction and the surface of charging member 2 is represented by z(x). Then z(x) becomes substantially constant between points B and C.

If the coordinates of points B and C are assumed to have the following values:

B(3.0 mm, 0.020 mm)

Figure 16:
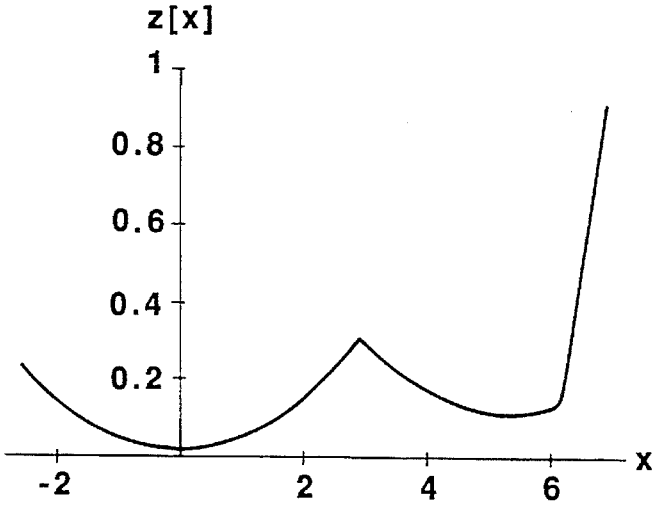
FIG. 16 is a graph illustrating the relationship between x and z(x)

C(6.0 mm,−1.105 mm), the relationship between x and z(x) becomes as a graph shown in FIG. 16.

(2) Correction Paschen curve vp(x)

The correction Paschen curve at point x on photosensitive drum 1 is expressed as follows:

$$vp(x)=312+6200\ z(x).$$

(3) When the applied voltage vq(t, n) is an AC voltage

The AC bias voltage applied to the charging member is expressed as follows:

$$vq(t,\ n)=\tfrac{1}{2}\times vpp\ \sin\ (2\ \pi ft(n-1))+dc,$$

where vpp is the peak-to-peak voltage of the applied bias voltage, f is the frequency of the applied bias voltage, t is ¼ t (¼ of one period (sampling interval), n is the number of sampling operations, and dc is the DC component. In the present embodiment, vpp equals 2200 V, f equals 350 Hz, and dc equals −600 V.

A pulsed bias voltage having a period of ¼ f is substituted for the applied voltage, since the frequency of the primary bias voltage is sufficiently large compared with the process speed, and therefore changes in the surface voltage of the photosensitive drum can be sufficiently followed.

Figure 17:
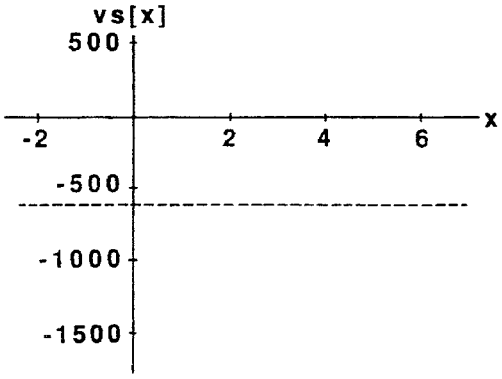
FIGS. 17(1) through 17(6) are graphs illustrating results of simulation for the surface potential on a photosensitive drum.
Figure 17:
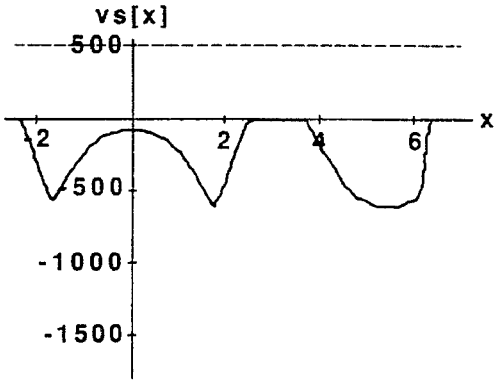
Figure 17:
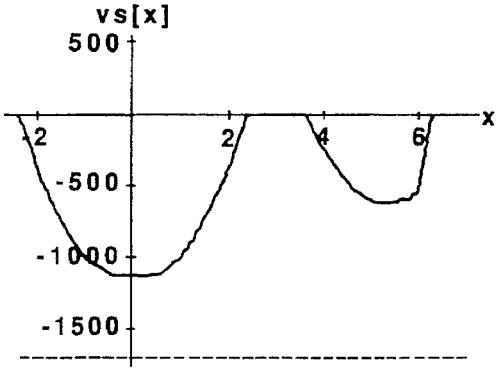
Figure 17:
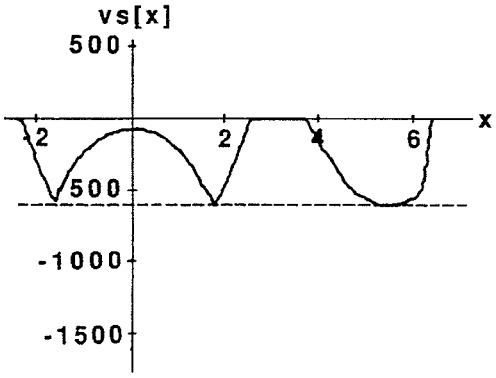
Figure 17:
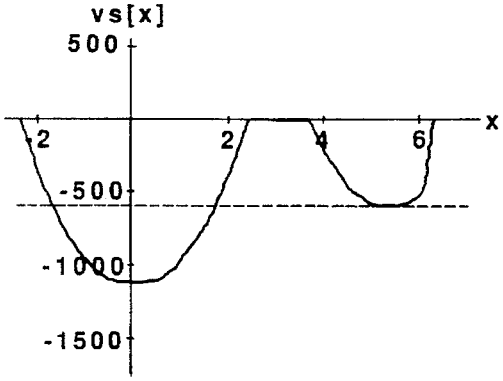
Figure 17:
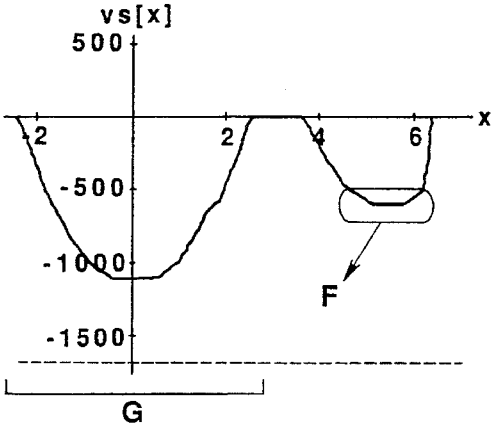

(4) FIG. 17(1) illustrates the surface potential vs(x,n) on the photosensitive drum.

In FIG. 17(1), the ordinate represents vs(x, n) (V), and the abscissa represents x (mm).

(5) Surface potential vs(x−vps×t, n) on the photosensitive drum after t seconds

After t seconds, the surface potential provided on the photosensitive drum moves to the right in FIG. 17(1) due to the rotation of the photosensitive drum. The moving direction in the x direction equals vps x t.

Results of Simulation

FIGS. 17(1) through 17(6) illustrate results of simulation of the surface potential rs(x, n) on the photosensitive drum when n is changed from 1 to 6.

In FIGS. 17(1) through 17(6), the ordinate represents the surface potential rs(x, n) on the photosensitive drum, and the abscissa represents x.

In FIG. 17(1) representing the case of n=1, the voltage applied from the charging member to the surface of the photosensitive drum is −600 V. Accordingly, the surface of the photosensitive drum is charged to a surface potential of only several tens of volts.

In FIG. 17(2) representing the case of n=2, the applied voltage is −1700 V after t seconds, and a wide region on the photosensitive drum is charged.

In FIG. 17(3) representing the case of n=3, the applied voltage returns to −600 V after an additional t seconds. At that time, the gap voltage provided by the applied voltage and the surface potential of the photosensitive drum does not exceed the discharge start voltage at any point. Accordingly, the surface potential on the photosensitive drum does not change, and only moves to the right in accordance with the process speed.

In FIG. 17(4) representing the case of n=4, the applied voltage becomes +500 V after an additional t seconds. At that time, the gap voltage provided by the applied voltage and the surface potential of the photosensitive drum exceeds the discharge start voltage at some portions. As a result, the surface potential on the photosensitive drum changes, and moves to the right in accordance with the process speed.

In FIG. 17(5) representing the case of n=5, the applied voltage returns to −600 V after an additional t seconds. At that time, the gap voltage provided by the applied voltage and the surface potential of the photosensitive drum does not exceed the discharge start voltage at any point. Accordingly, the surface potential on the photosensitive drum does not change, and only moves to the right in accordance with the process speed.

In FIG. 17(6) representing the case of n=6, the applied voltage becomes −1700 V after an additional t seconds. At that time, the gap voltage provided by the applied voltage and the surface potential of the photosensitive drum exceeeds the discharge start voltage at some portions. As a result, the surface potential on the photosensitive drum changes, and moves to the right in accordance with the process speed.

Figure 18:
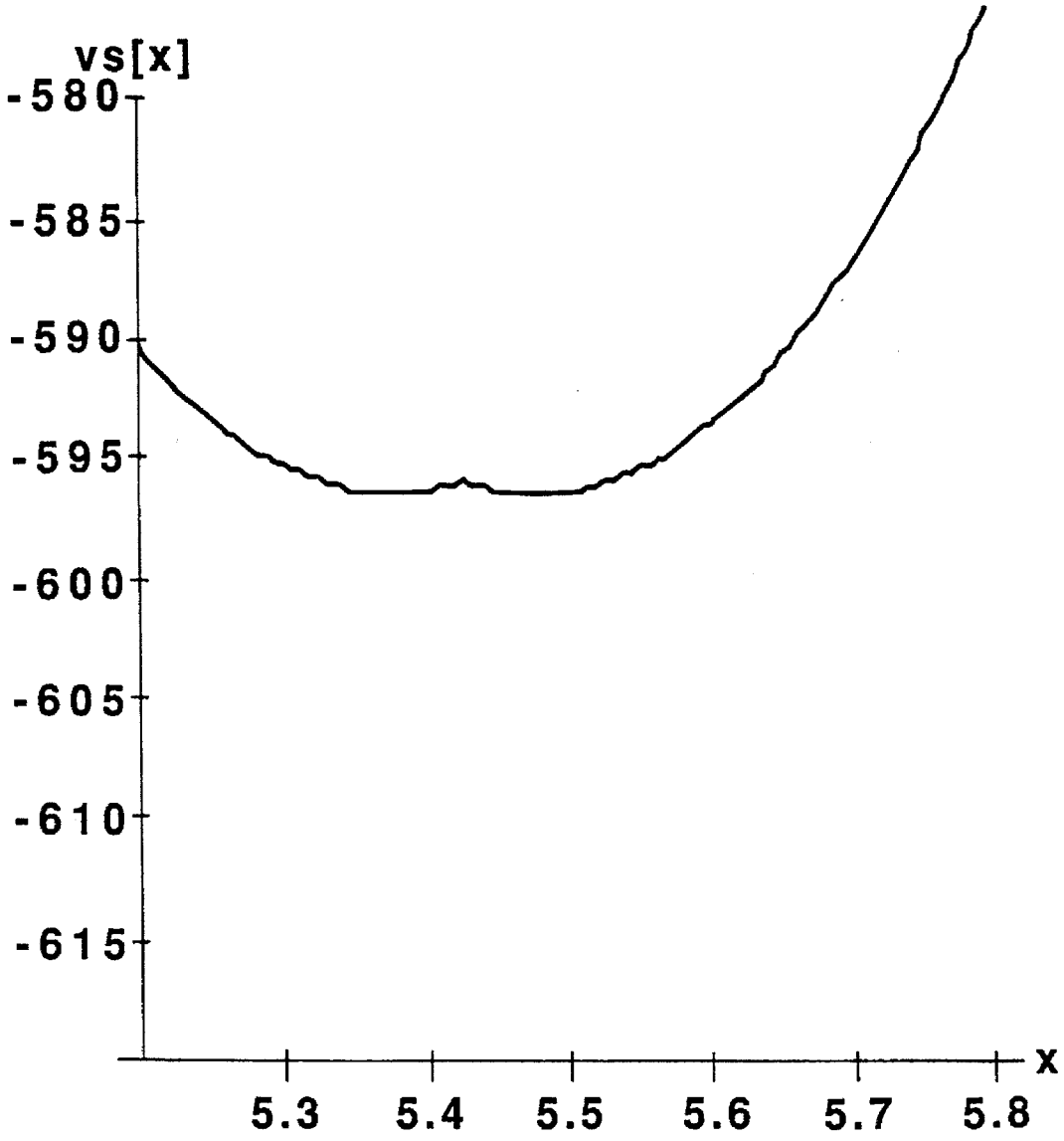
FIG. 18 is an enlarged graph of portion F of FIG. 17(6)

Portion F indicated in FIG. 17(6) corresponds to the surface potential of the photosensitive drum whose peak-to-peak voltage becomes the peak-to-peak voltage of the cycle pattern. FIG. 18 is an enlarged graph of portion F. In FIG. 18, the ordinate represents the surface potential of the photosensitive drum, and the abscissa represents x. In the present embodiment, the peak-to-peak voltage (V-cycle-pp) of the cycle pattern by charging equals substantially 0 V.

In region G shown in FIG. 17(6), the effect of averaging the surface potential of the photosensitive drum is recognized as in the above-described embodiments, since the photosensitive drum is repeatedly charged and discharged by charging member 2.

$V_d=(V_a+V_b)/2$, and $|V_d-V_a|\geqq$ the discharge start voltage, and $|V_d-V_b|\geqq$ the discharge start voltage, that is, the absolute value of a value obtained by subtracting the maximum value $V_a$ or the minimum value $V_b$ of the pulsed bias voltage from the surface potential $V_d$ of the photosensitive drum is greater than the discharge start voltage (about 580 V in the present embodiment). Hence, the surface potential $V_d$ of the photosensitive drum is sufficiently charged and discharged by the charging member, whereby the potential is averaged.

In contact charging, the waveform of the applied bias voltage influences charging tone. The charging tone is greater in the case of a sine-wave voltage than in the cases of a triangular-wave voltage, a sawtooth-wave voltage, and a rectangular-wave voltage.

The reason is considered to be as follows. That is, as described with reference to FIGS. 14(*a*) through 14(*c*), a change in oscillation is greater and therefore charging tone is also greater when the applied voltage gradually changes than when it abruptly changes. Accordingly, if the charging member is disposed in a state of not contacting the member to be charged as in the present embodiment, substantially noncontact charging (the charging member is very close to the photosensitive drum) substantially free from charging tone can be performed. Moreover, a power supply which provides a bias voltage comprising a triangular wave, a sawtooth wave, a rectangular wave, pulses, or the like can be produced with a lower cost than with a sine-wave power supply.

Since charging tone is not noticeable, it is possible to increase the frequency of the primary power supply, and to reduce the cycle pattern and interference fringes. The applied bias voltage having the waveform of the above-described triangular wave, sawtooth wave, rectangular wave provided from a DC power supply, pulses or the like will cause no problem even if the waveform is more or less distorted, provided that the above-described conditions are satisfied.

In image output in the above-described system, the cycle pattern completely disappeared even in a halftone image, and excellent images free from the memory effect of the photosensitive drum were obtained.

Figure 31:
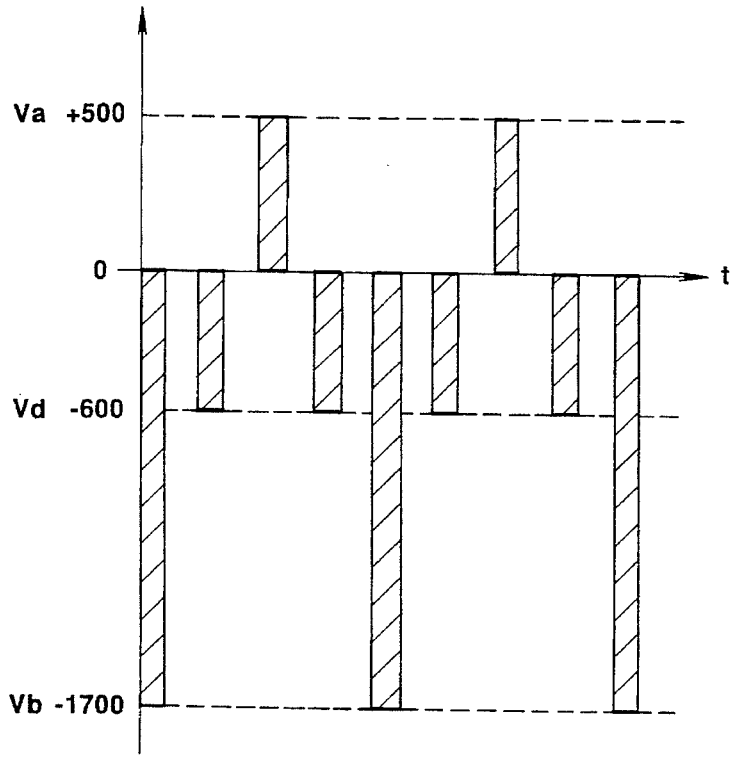
Figure 32:
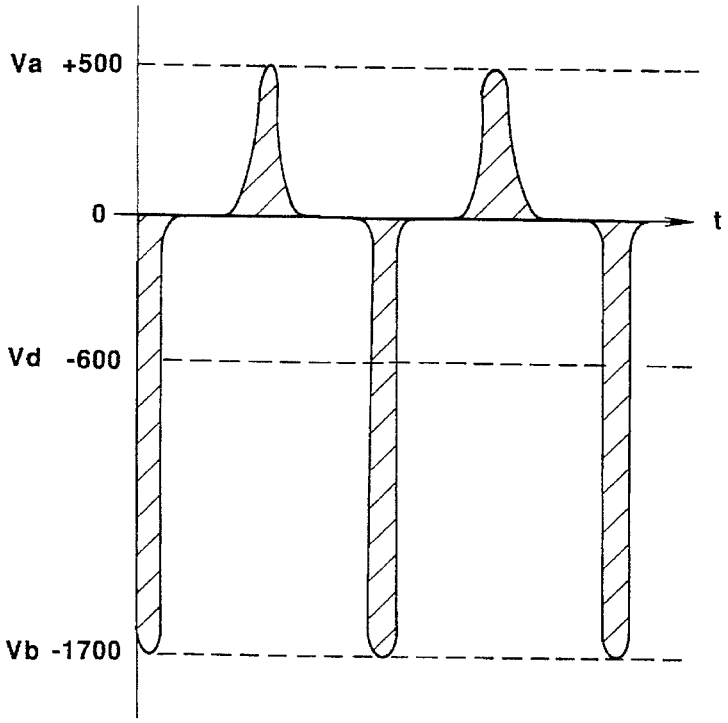

In the above-described embodiment, a pulsed bias voltage illustrated in FIG. 31 is applied to the charging member. However, it is only necessary to use pulsed voltages whose maximum value $V_a$ and minimum value $V_b$ satisfy the above-described conditions, and it is unnecessary to use other pulsed voltages. Furthermore, the pulsed bias voltage may have a rise portion. Accordingly, the same effect as described above can be obtained even if a pulsed bias voltage shown in FIG. 32 is used. In FIGS. 31 and 32, the ordinate represents the applied voltage, and the abscissa represents time base t.

If such a pulsed bias voltage is used, it is possible to reduce the cost of the primary bias power supply, and to provide an image forming apparatus free from charging tone and interference fringes.

Figure 33:
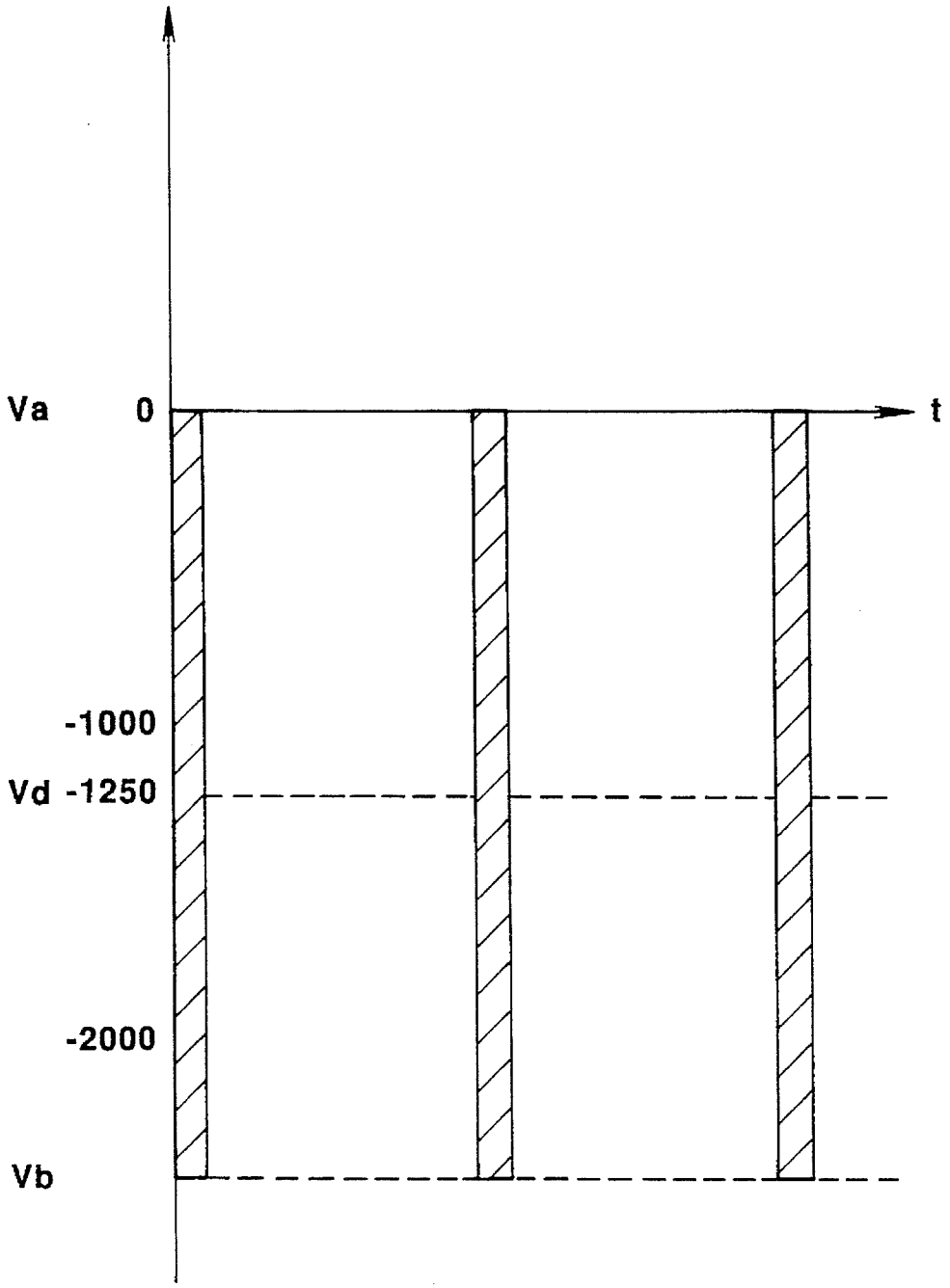
FIGS. 31 through 33 are diagrams illustrating the waveforms of pulsed bias voltages applied to the charging member.

FIG. 33 shows another example of a pulsed bias voltage. This pulsed bias voltage corresponds to a case in which $V_a$=0 V, $V_b$=−2500 V, and $V_d$=−1250 V. In FIG. 33, the ordinate represents the applied voltage, and the abscissa represents time base t.

Application of such a pulsed bias voltage has the advantage that only one primary bias power supply is necessary. That is, it is possible to provide a pulsed bias voltage by chopping a single DC power source. Since the production cost of a DC power supply is less than that of an AC power supply, the cost of the primary bias power supply can be greatly reduced.

As described above, by providing in a charging member a region, in which the distance between the charging surface of the charging member and the surface of a member to be charged is smaller in the upstream portion in the moving direction of the surface of the member to be charged than in the downstream portion on the charging surface of the charging member, and a region, in which the above-described distance is substantially constant in the downstream portion, the peak-to-peak voltage of the cycle pattern becomes less noticeable, and the frequency of the applied voltage can be reduced. As a result, it becomes possible to suppress interference fringes and charging tone to a level of no importance.

The fact that the peak-to-peak voltage of the cycle pattern can be reduced indicates that the frequency of the applied voltage can be reduced at the same process speed. As a result, charging tone can also be reduced.

The apparatus shown in FIG. 15, in which the AC component frequency was reduced from 350 Hz to 200 Hz, was placed in an anechoic room, and noise in the above-described conditions was measured conforming to paragraph 6 of ISO 7779. The result of the measurement indicates that the noise level close to 55 dB obtained in the case of the conventional approach was reduced to as small as 33 dB. In addition, interference fringes in output images were not noticeable at all.

Figure 19:
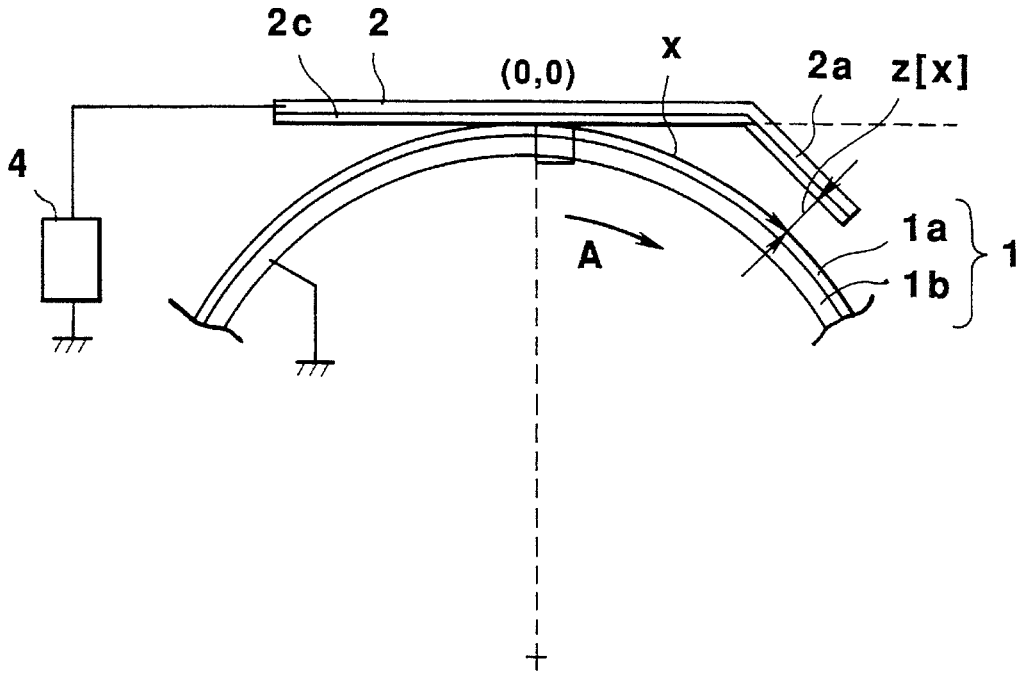
FIG. 19 is a diagram showing the schematic configuration of a principal portion of a charging member according to a fifth embodiment of the present invention.

FIG. 19 is a diagram showing the configuration of a charging member according to a fifth embodiment of the present invention.

As shown in FIG. 19, a protective layer may be provided on the surface of the charging member in order that, for example, abnormal discharge, such as current leakage or the like, from the charging member does not occur in a defective portion, such as a pinhole or the like, which may be present on the surface of a member to be charged.

In the present embodiment, high-resistance layer 2*c* made of epichlorohydrin rubber, tolidine, or the like, is provided on the surface of electrode plate 2, serving as the charging member, shown in FIG. 15, facing photosensitive drum 1. The same effect may, of course, be obtained using such charging member 2.

Figure 20:
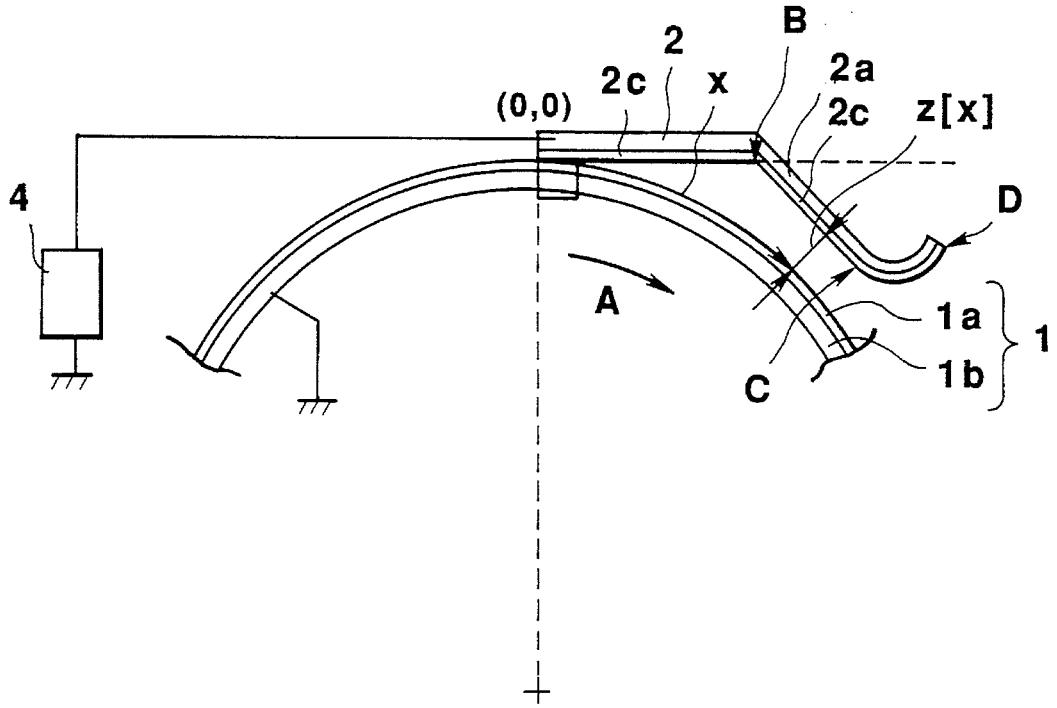
FIG. 20 is a diagram showing the schematic configuration of a principal portion of a charging member according to a sixth embodiment of the present invention.

FIG. 20 is a digram showing the configuration of a charging member according to a sixth embodiment of the present invention.

In the present embodiment, as shown in FIG. 20, in comparison with the charging member shown in FIG. 15, the charging member is provided only at the downstream side from the closest point or the contact point between photosensitive drum 1 and charging member 2.

In this case, it is possible to make charging member 2 very compact. Although the effect of averaging the surface potential on the photosensitive drum is halved, this disadvange will be overcome by increasing the frequency of the charging bias voltage, or increasing the charged region by increasing the width of the charging member.

As shown in FIG. 20, an end portion of charging member 2 is upwardly bent between points C and D. Even in such a structure, the peak-to-peak voltage of the cycle pattern on photosensitive drum 1 is determined by the shape of charging member 2 between points B and C. Hence, it is possible to provide the surface potential on photosensitive drum 1 almost free from the cycle pattern.

Figure 21:
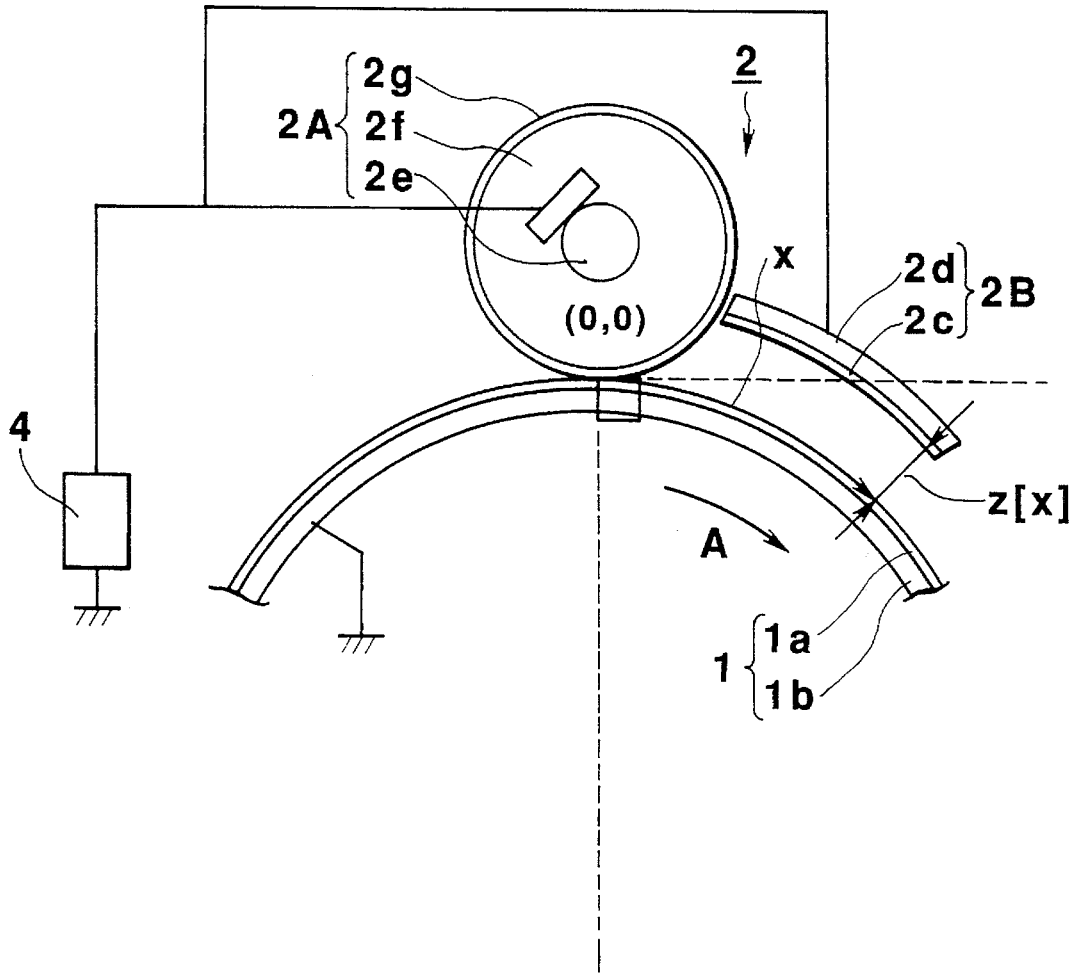
FIG. 21 is a diagram showing the schematic configuration of a principal portion of a charging member according to a seventh embodiment of the present invention.

FIG. 21 is a diagram showing the configuration of a charging member according to a seventh embodiment of the present invention.

As shown in FIG. 21, in the present embodiment, charging member 2 comprises charging roller 2A and charging plate (electrode plate) 2B. Charging roller 2A comprises metal core bar 2*e*, low-resistance layer 2*f*, and high-resistance layer 2*g*, having a volume resistivity greater than that of low-resistance layer 2*f*, in the order from the inside to the outside. A bias voltage is applied from power supply 4 to core bar 2*e*. High-resistance layer 2*g* is provided for the purpose of preventing leakage discharge at a defect, such as a pinhole or the like, on photosensitive drum 1, even if such a defect is present.

Charging plate 2B is arranged so that the distance between its charging surface and photosensitive drum 1 is substantially constant at the downstream side from charging roller 2A in the direction of rotation of photosensitive drum 1. Charging plate 2B comprises electrode plate 2*d*, and high-resistance layer 2*c*, made of epichlorohydrin rubber, tolidine or the like, provided on the surface of electrode plate 2*d* facing photosensitive drum 1.

Also in the configuration of the present embodiment, the peak-to-peak voltage of the cycle pattern is reduced, and interference fringes can be suppressed to a level of no importance.

Figure 22:
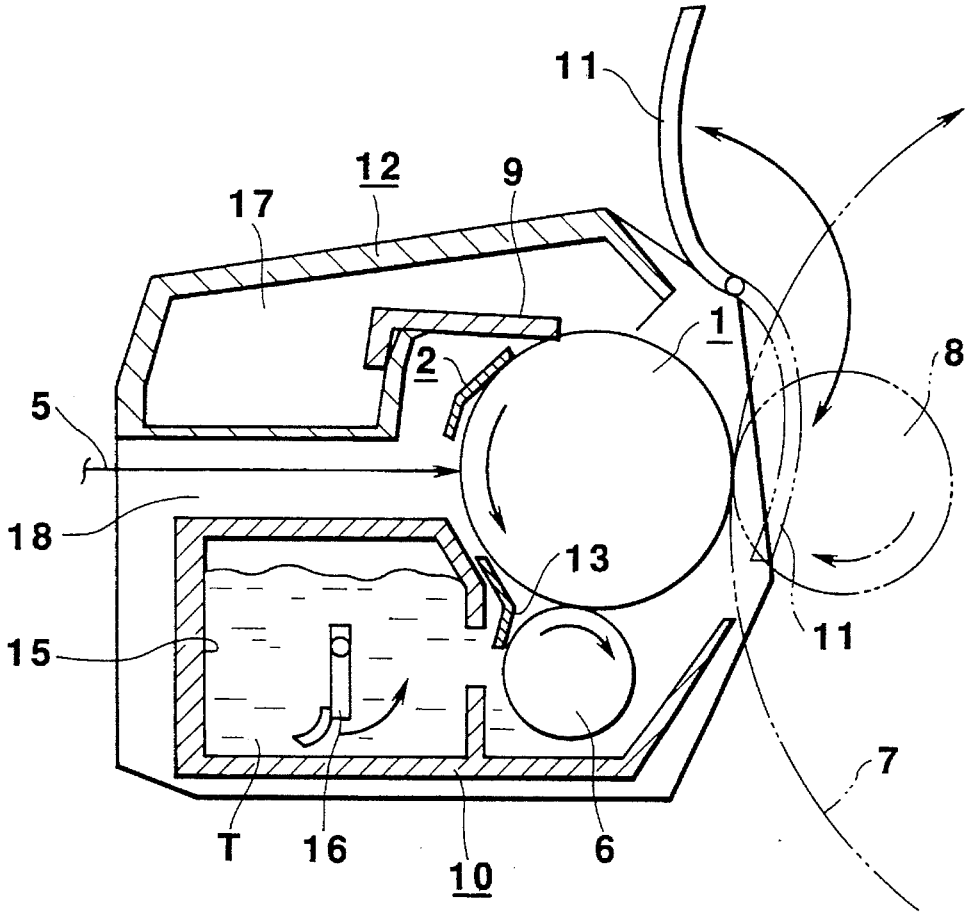
FIG. 22 is a diagram showing the schematic configuration of a process cartridge including a charging member.

Each of the charging members of the fourth through seventh embodiments may be provided within the process cartridge of the image forming apparatus. FIG. 22 illustrates a case in which the charging member shown in FIG. 15 or 19 is provided within the cartridge.

Figure 23:
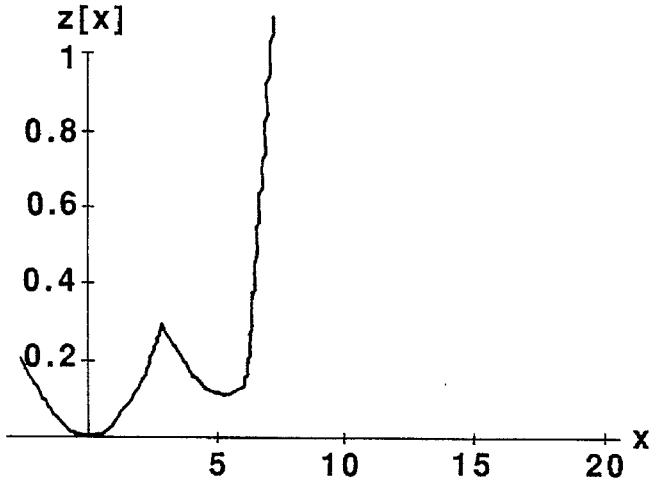
FIG. 23 is a diagram illustrating the relationship between x and z(x)
Figure 24:
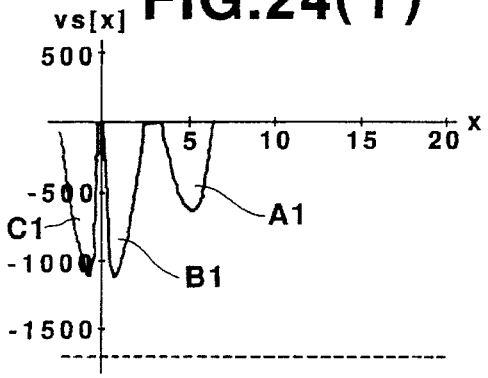
FIGS. 24(1) through 28(6) are graphs showing results of simulation for the surface potential on a photosensitive drum.
Figure 24:
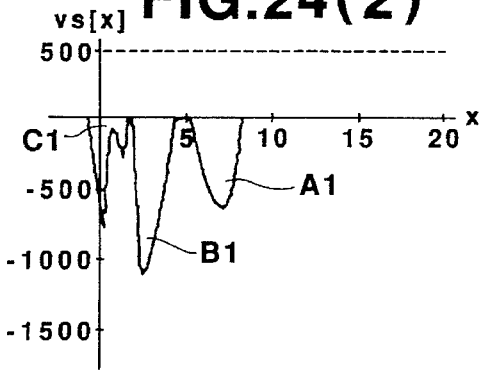
Figure 24:
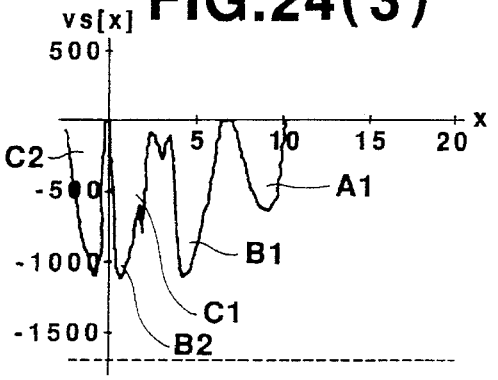
Figure 24:
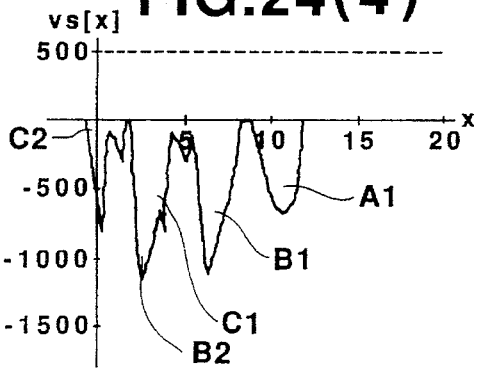
Figure 24:
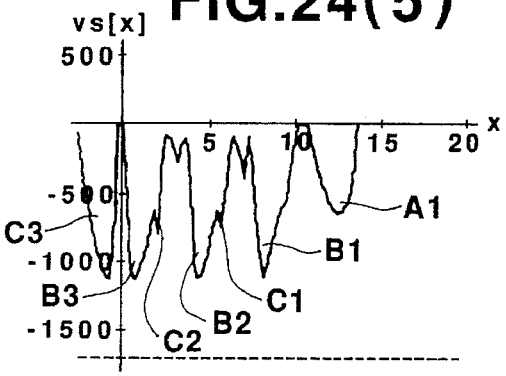
Figure 24:
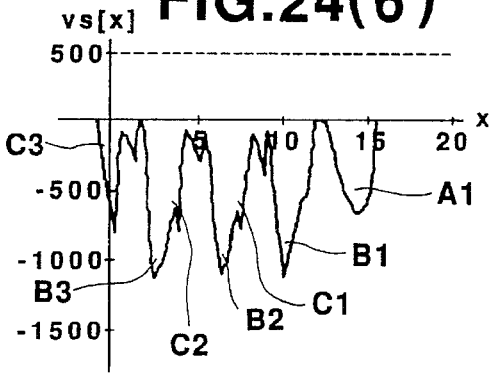
Figure 24:
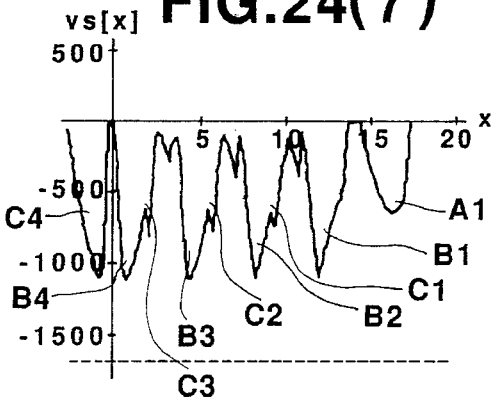

FIG. 23 is a graph illustrating the relationship between the gap distance z(x) and x when the charging member contacts the photosensitive drum in the case of FIG. 15. In such as case, the coordinates of points B and C become (3.0, 0.000) and (6.0,−1.107), respectively. FIG. 24(1) is a graph illustrating the surface potential vs(x, n) on the photosensitive drum when f=10 Hz, and 40 Hz. In FIG. 24(1), the ordinate represents vs(x, n), and the abscissa represents x. Other conditions are the same as the above-described conditions.

Figure 25:
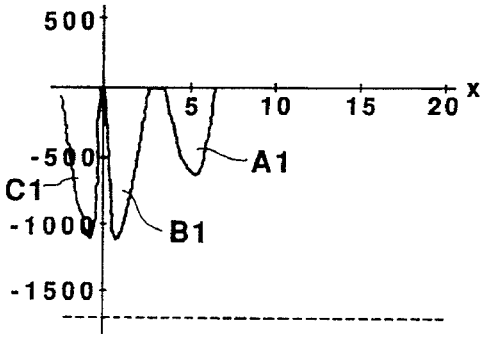
Figure 25:
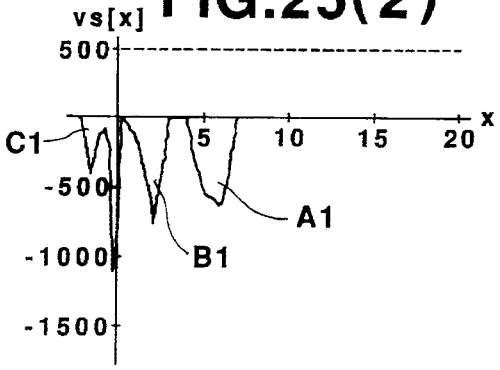
Figure 25:
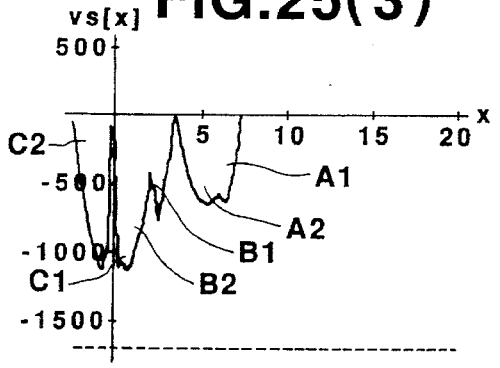
Figure 25:
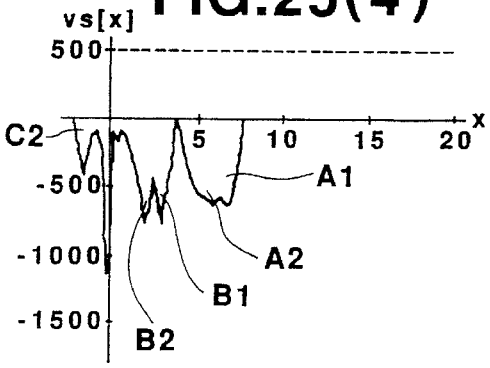
Figure 25:
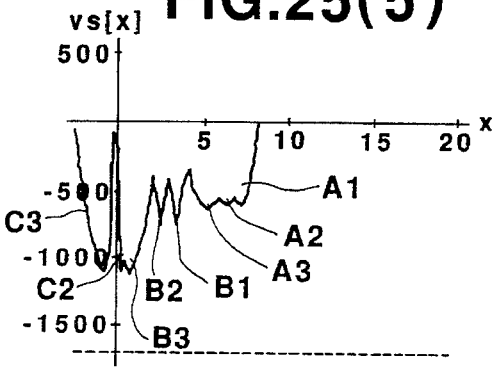
Figure 25:
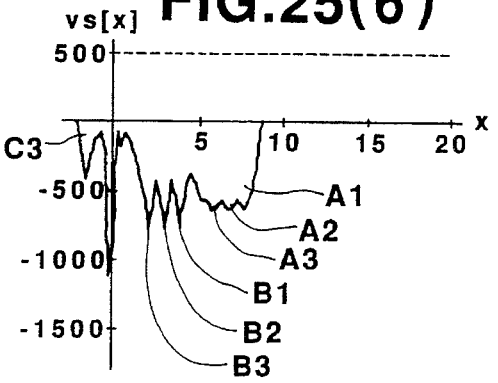
Figure 25:
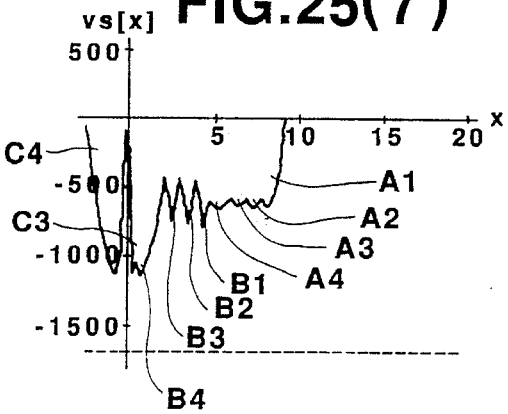

Results of Simulation of the Surface Potential vs(x, n) on the Photosensitive Drum The surface potential provided on the photosensitive drum moves to the right of the graph after t seconds by the rotation of the photosensitive drum. FIGS. 24(1) through 25(7) are graphs illustrating the movement of the surface potential on the photosensitive drum. In FIGS. 24(1) through 25(7), the ordinate represents vs(x−vps×t, n), and the abscissa represents x. The moving distance in the x direction equals vsp×t. FIGS. 24(1) through 24(7) indicate the case in which the frequency of the applied voltage equals 10 Hz. FIGS. 25(1) through 25(7) indicate the case in which the frequency of the applied voltage equals 40 Hz.

When the Frequency of the Applied Voltage Equals 10 Hz

In FIG. 24(1) representing the case of n=1, the voltage applied from the charging member to the surface of the photosensitive drum becomes −1700 V, and a wide range on the photosensitive drum is charged. In FIG. 24(1), region A1 corresponds to a portion charged by a portion between B and C of charging member 2*a*. Regions B1 and C1 correspond to portions at the downstream side and the upstream side from the contact point between charging member 2*a* and photosensitive drum 1, respectively, charged while satisfying the charging conditions.

In FIG. 24(2) representing the case of n=2, the applied voltage becomes +500 V after t seconds. At that time, the gap voltage provided by the applied voltage and the surface potential of the photosensitive drum exceeds the discharge start voltage at the charged region C1. As a result, the surface potential of region C1 on the photosensitive drum is charged in the opposite polarity, and has the shape indicated by C1 in FIG. 24(2). Then the charged region moves to the right in accordance with the process speed. Since the charged regions A1 and B1 do not have portions exceeding the discharge start voltage even though the bias voltage of +500 V is applied, charging to the opposite polarity does not occur, and therefore the shapes do not change.

In FIG. 24(3) representing the case of n=3, the voltage applied from the charging member to the surface of the photosensitive drum after an additional t seconds becomes −1700 V, and the same region of the photosensitive drum as in the case of FIG. 24(1) is newly charged. As a result, regions B2 and C2 are added. However, since the charged region A1 shown in FIG. 24(1) is included within the charged region B1 shown in FIG. 24(3), charging does not newly occur. Then the charged regions move to the right in accordance with the process speed.

In FIG. 24(4) representing the case of n=4, the applied voltage after an additional t seconds becomes +500 V. At that time, the gap voltage provided by the applied voltage and the surface potential of the photosensitive drum exceeds the discharge start voltage at region C2. As a result, the surface potential of region C2 on the photosensitive drum is charged to the opposite polarity, and has the shape shown in FIG. 24(4). Then the charged regions move to the right in accordance with the process speed. Since the charged regions A1, B1, C1 and B2 do not have portions exceeding the discharge start voltage even though the bias voltage of +500 V is applied, charging to the opposite polarity does not occur, and therefore the shapes do not change.

In FIG. 24(5) representing the case of n=5, the voltage applied to the surface of the photosensitive drum after an additional t seconds becomes −1700 V, and the same region of the photosensitive drum as in the case of FIG. 24(1) is charged. As a result, regions B3 and C3 are added. However, since the charged region A1 shown in FIG. 24(1) is included within the charged region B2 shown in FIG. 24(5), charging does not newly occur. Then the charged regions move to the right in accordance with the process speed, Since the charged regions A1, B1, C1 and B2 do not have portions exceeding the discharge start voltage even though the bias voltage of −1700 V is applied, charging to the opposite polarity does not occur, and therefore the shapes do not change.

In FIG. 24(6) representing the case of n=6, the applied voltage becomes +500 V after an additional t seconds. At that time, the gap voltage provided by the applied voltage and the surface potential of the photosensitive drum exceeds the discharge start voltage at region C3. As a result, the surface potential of region C3 on the photosensitive drum is charged in the opposite polarity, and has the shape shown in FIG. 24(6). Then the charged region moves to the right in accordance with the process speed. Since the charged regions A1, B1, C1, B2, C2 and B3 do not have portions exceeding the discharge start voltage even though the bias voltage of +500 V is applied, charging to the opposite polarity does not occur, and therefore the shapes do not change.

In FIG. 24(7) representing the case of n=7, the voltage applied to the surface of the photosensitive drum after an additional t seconds becomes −1700 V, and the same region of the photosensitive drum as in the case of FIG. 24(1) is charged. As a result, regions B4 and C4 are added. However, since the charged region A1 shown in FIG. 24(1) is included within the charged region B3 shown in FIG. 24(7), charging does not newly occur. Then the charged regions move to the right in accordance with the process speed. Since the charged regions A1, B1, C1, B2, C2 and B3 do not have portions exceeding the discharge start voltage even though the bias voltage of −1700 V is applied, charging to the opposite polarity does not occur, and therefore the shapes do not change.

As is apparent from these results, when the process speed equals 12 πmm/s and the charged regions has the width corresponding to this speed, the frequency of the applied bias voltage of 10 Hz is so slow that large valleys are provided in the potential between regions B1 and B2, B2 and B3, and B3 and B4, and therefore uniform charging cannot be performed.

When the Frequency of the Applied Bias Voltage Equals 40 Hz

In FIG. 25(1) representing the case of n=1, the voltage applied from the charging member to the surface of the photosensitive drum becomes −1700 V, and a wide range on the photosensitive drum is charged. In FIG. 25(1), region A1 corresponds to a portion charged by a portion between B and C of charging member 2*a*. Charged regions B1 and C1 corresponding to portions at the right and the left of the contact point between charging member 2*a* and photosensitive drum 1, respectively, are charged while satisfying the charging conditions.

In FIG. 25(2) representing the case of n=2, the applied voltage becomes +500 V after t seconds. At that time, the gap voltage provided by the applied voltage and the surface potential of the photosensitive drum exceeds the discharge start voltage at the leading end of the charged region A1, and regions B1 and C1. As a result, the surface potentials of the leading end of region A1, and regions B1 and C1 on the photosensitive drum are charged in the opposite polarity, and have the shapes indicated by A1, B1 and C1 in FIG. 25(2). Then the charged region moves to the right in accordance with the process speed.

Figure 28:
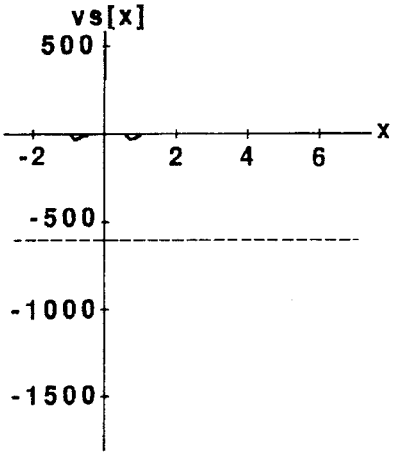
Figure 28:
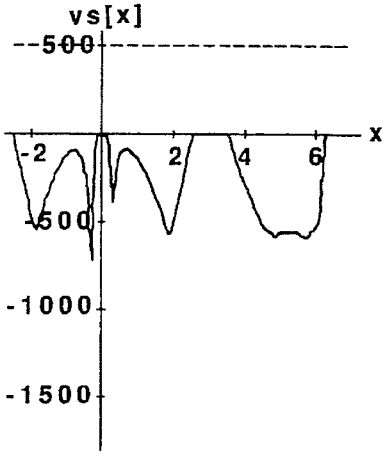
Figure 28:
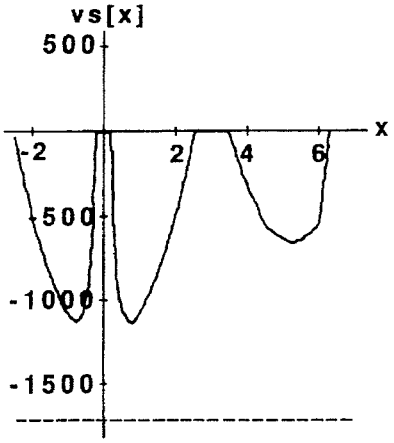
Figure 28:
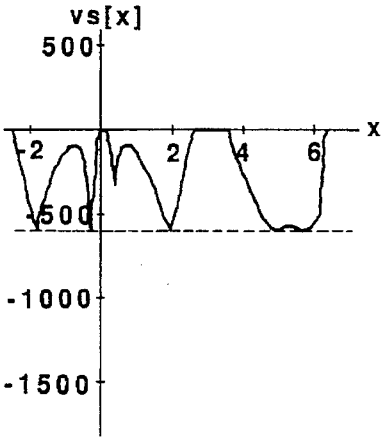
Figure 28:
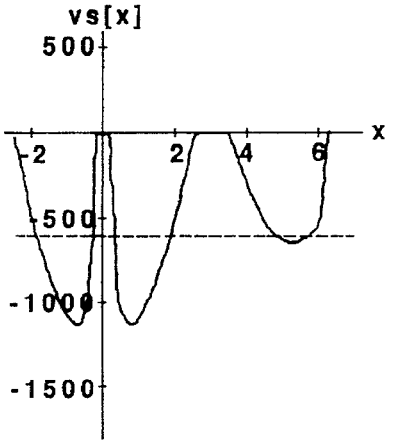
Figure 28:
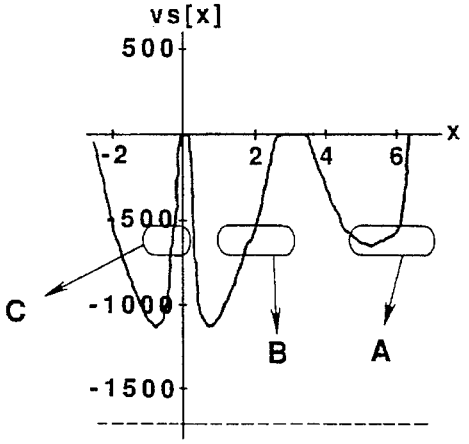

In FIG. 28(8) representing the case of n 32 3, the voltage applied from the charging member to the surface of the photosensitive drum after an additional t seconds becomes −1700 V, and the same region of the photosensitive drum as in the case of FIG. 25(1) is newly charged. As a result, regions A2, B2 and C2 are added. Then the charged regions move to the right in accordance with the process speed. However, since the frequency of the applied bias voltage is 40 Hz in place of 10 Hz and therefore the period is short, region A2 is charged adjacent to region A1.

In FIG. 25(4) representing the case of n=4, the applied voltage after an additional t seconds becomes +500 V. At that time, the gap voltage provided by the applied voltage and the surface potential of the photosensitive drum exceeds the discharge start voltage at the leading end of region A2, and regions C1, C2 and B2. As a result, the surface potentials of the leading end of region A2, and regions C1, C2 and B2 on the photosensitive drum are charged to the opposite polarity, and have the shapes shown in FIG. 25(4). Then the charged regions move to the right in accordance with the process speed. Since the charged regions A1 and B1 do not have portions exceeding the discharge start voltage even though the bias voltage of +500 V is applied, charging to the opposite polarity does not occur, and therefore the shapes do not change.

In FIG. 25(5) representing the case of n=5, the voltage applied from the charging member to the surface of the photosensitive drum after an additional t seconds becomes −1700 V, and the same region of the photosensitive drum as in the case of FIG. 25(1) is charged. As a result, regions A3, B3 and C3 are added. Then the charged regions move to the right in accordance with the process speed. Since the charged regions A1, A2, B1 and B2 do not have portions exceeding the discharge start voltage even though the bias voltage of −1700 V is applied, charging to the opposite polarity does not occur, and therefore the shapes do not change. Since region C2 is influenced by regions C3 and B3, only its leading-end portion remains.

In FIG. 25(6) representing the case of n=6, the applied voltage becomes +500 V after an additional t seconds. At that time, the gap voltage provided by the applied voltage and the surface potential of the photosensitive drum exceeds the discharge start voltage at the leading end of region A3, and regions C2, C3 and B3. As a result, the surface potentials of the leading end of region A3, and regions C2, C3 and B3 on the photosensitive drum are charged in the opposite polarity, and have the shapes shown in FIG. 25(6). Then the charged regions move to the right in accordance with the process speed. Since the charged regions A1, A2, B1 and B2 do not have portions exceeding the discharge start voltage even though the bias voltage of +500 V is applied, charging to the opposite polarity does not occur, and therefore the shapes do not change.

In FIG. 25(7) representing the case of n=7, the voltage applied from the charging member to the surface of the photosensitive drum after an additional t seconds becomes −1700 V, and the same region of the photosensitive drum as in the case of FIG. 25(1) is charged. As a result, regions A4, B4 and C4 are added. Then the charged regions move to the right in accordance with the process speed. Since the charged regions A1, A2, A3, B1, B2 and B3 do not have portions exceeding the discharge start voltage even though the bias voltage of −1700 V is applied, charging to the opposite polarity does not occur, and therefore the shapes do not change. Since region C3 is influenced by regions C4 and B4, only its leading-end portion remains.

As is apparent from these results, when the process speed equals 12 πmm/s and the charged region has the width corresponding to this speed, if the frequency of the applied voltage equals 40 Hz, region A2 is charged immediately after region A1, adjacent to which regions A3 and A4 are charged.

In FIGS. 25(1) through 25(7), regions indicated by A determine the final smooth surface potential of the photosensitive drum, and regions indicated by B and C correspond to averaging regions in which the grid effect by the applied AC bias voltage appears.

Conditions for Smooth Charging

Figure 26:
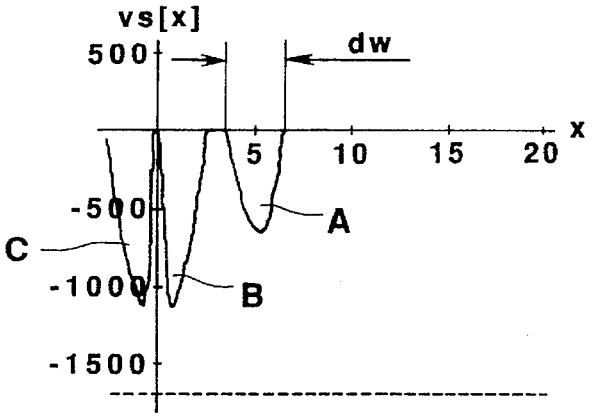
Figure 26:
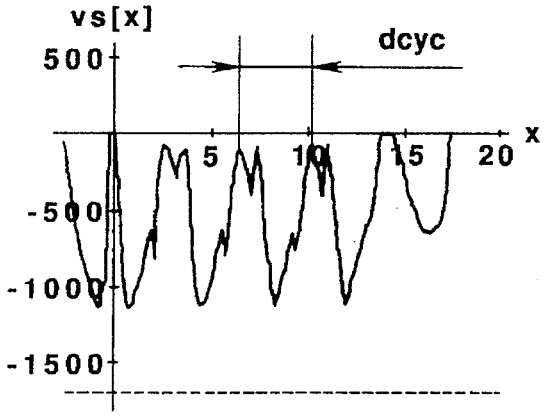
Figure 26:
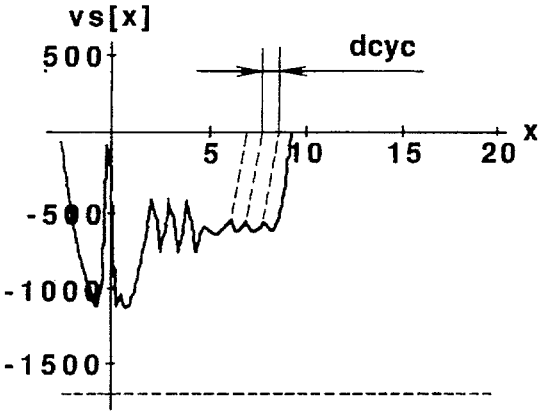

Next, conditions for smoothing charging will be described. In FIG. 26(1), symbol A represents a charged region at the most downstream portion in the direction of rotation of the photosensitive drum, and symbol $d_w$ represents the width of charged region A, which equals 3.03 mm in the present embodiment. The peak charging voltage is −636 V. Symbols B and C represent charged regions at portions upstream from the charged region A in the moving direction of the photosensitive drum, both having a width of 2.48 mm and a peak charging voltage of −1100 V.

In the Case of 10 Hz

In FIG. 26(2), $d_{cyc}$ represents the pitch of the charging cycle when the applied voltage equals 10 Hz, and is expressed as follows:

$$d_{cyc}=V_{ps}/f \quad (15),$$

where $V_{ps}$ is the process speed of the photosensitive drum, and f is the frequency of the applied voltage.

In the present embodiment, when the frequency of the applied voltage equals 10 Hz, the value of $d_{cyc}$ (10 Hz) equals 3.77 mm. In this case, the lower peak value and the upper peak value of the cycle pattern are −1110 V, and −69 V, respectively. Accordingly, the peak-to-peak voltage is 1041 V.

In this case, the following relationship holds between the width $d_w$ of the charged region and the pitch $d_{cyc}$ (10 Hz) of the charging cycle:

$$d_{cyc} \geqq d_w \quad (16).$$

As is apparent from FIG. 26(2), remarkable valleys are provided in the surface potential of the photosensitive drum under this condition, and smooth charging cannot be performed.

In the Case of 40 Hz

In FIG. 26(3), $d_{cyc}$ represents the pitch of the charging cycle when the frequency of the applied voltage equals 40 Hz. In the present embodiment, when the frequency of the applied voltage equals 40 Hz, the value of $d_{cyc}$ (40 Hz) equals 0.94 mm. In this case, the following relationship holds between the width $d_w$ of the charged region and the pitch $d_{cyc}$ (10 Hz) of the charging cycle:

$$d_{cyc} \leqq d_w \quad (17).$$

As is apparent from FIG. 26(3), little uneveness is present in the surface potential of the surface of the photosensitive drum, and smooth charging can be performed.

In this case, the lower peak value and the upper peak value of the cycle pattern in the smoothed region A are −622 V and −562 V, respectively. Accordingly, the peak-to-peak voltage is 60 V. The lower peak value and the upper peak value of the cycle pattern in the averaging region B is −756 V and −442 V, respectively. Accordingly, the peak-to-peak voltage is 314 V.

In image output in the above-described system, the cycle pattern was hardly recognized even in a halftone image, and excellent images free from the memory effect of the photosensitive drum were obtained.

As described above, in an image forming apparatus in which an oscillating voltage is applied to a charging member, the surface of an image bearing member is charged by contacting the charging member with the image bearing member, and an image is formed on the charged surface of the image bearing member by writing image information thereon, by providing in the charging member a region, in which the distance between the charging surface of the charging member and the surface of the image bearing member is smaller in the upstream portion in the direction of rotation of the surface of the image bearing member than in the downstream portion on the charging surface of the charging member, and a region, in which the above-described distance is substantially constant in the downstream portion, and by satisfying the relationship of $d_{cyc} \leqq d_w$ between width $d_w$ of a charged region in the most downstream portion and pitch $d_{cyc}$ of the charging cycle, the cycle pattern becomes less noticeable, and the frequency of the applied bias voltage can be reduced. As a result, it becomes possible to suppress interference fringes and charging tone to a level of no importance. The width of the charged region may be measured with charging the member to be charged by the charging member while stopping the member to be charged, and performing developing without performing image exposure.

The fact that the peak-to-peak voltage of the cycle pattern can be reduced indicates that the frequency of the applied bias voltage can be reduced at the same process speed. As a result, charging tone can also be reduced. The inventors of the present invention placed the apparatus shown in FIG. 15, in which the frequency was set to 40 Hz, in an anechoic room, and noise in the above-described conditions was measured conforming to paragraph 6 of ISO 7779. The result of the measurement indicates that a noise level close to 55 dB obtained in the case of the conventional approach was reduced to as small as 30 dB. In addition, interference fringes were not noticeable at all.

Figure 27:
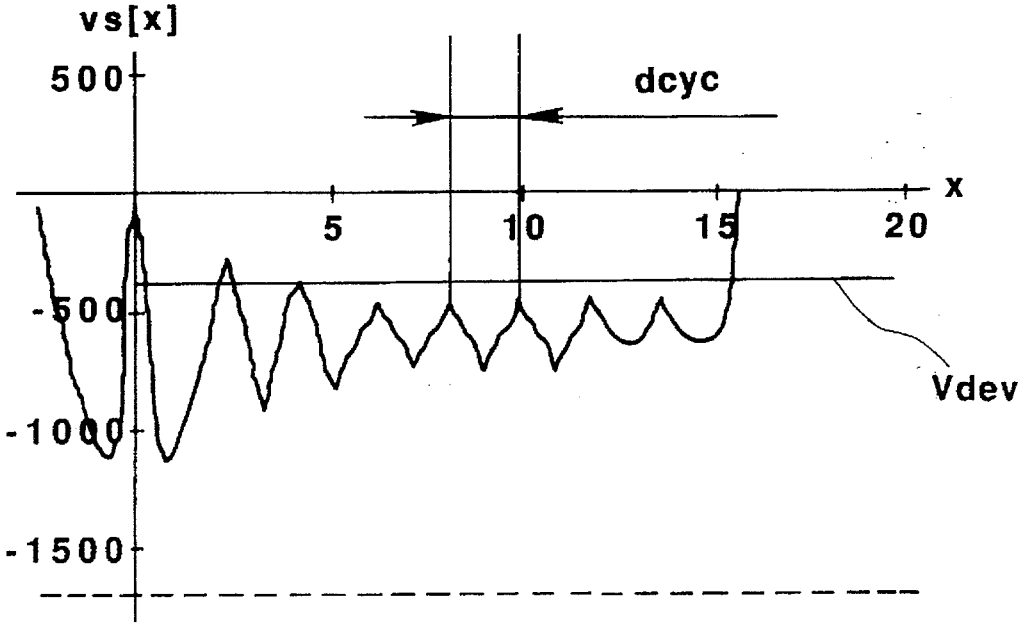

In the case shown in FIG. 19 in which the high-resistance layer is provided on the surface of the charging member as described above, the frequency of the applied bias voltage was 20 Hz, the peak-to-peak voltage was 2200 V, and the DC component of the bias voltage was −600 V. FIG. 27 is a graph showing the result of measurement in such conditions. In this case, the pitch $d_{cyc}$ (20 Hz) of the charging cycle is 1.88 mm, which is smaller than the width $d_w$ of the charged region (=3.03 mm) and therefore satisfies the conditions for smooth charging. However, the lower peak value and the upper peak value of the cycle pattern in the smoothed region A are −741 V and −457 V. Hence, the peak-to-peak voltage is 284 V, which is a considerably large value. Even in such a case, however, the lower limit value of the developing bias voltage may be set to a value sufficiently higher than the upper peak value −457 V of the cycle pattern.

In the above-described charging members having various shapes, it is, of course, preferable that the condition $d_{cyc} \leqq d_w$ is satisfied.

While FIGS. 17(1) through 17(6) are graphs illustrating changes in the surface potential of the photosensitive drum when the charging member having the shape shown in FIG. 15 is disposed in the proximity of the photosensitive drum with a gap of about 20 μm, FIGS. 28(1) through 28(6) are graphs illustrating changes in the surface potential of the photosensitive drum when the charging member having the same shape as in FIG. 15 contacts the photosensitive drum. Other conditions are the same as in the case of FIGS. 17(1) through 17(6). That is, FIGS. 28(1) through 28(6) illustrate changes in the surface potential of the photosensitive drum when n is changed from 1 to 6.

Figure 29:
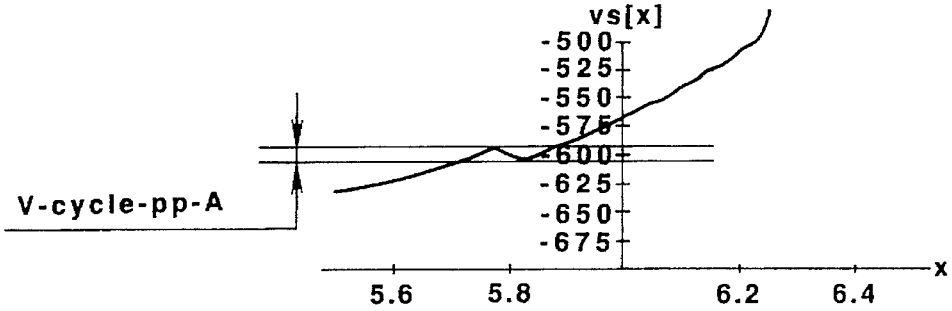
FIGS. 29(1) through 29(3) are enlarged graphs of portions A, B and C of FIG. 28(6), respectively.
Figure 29:
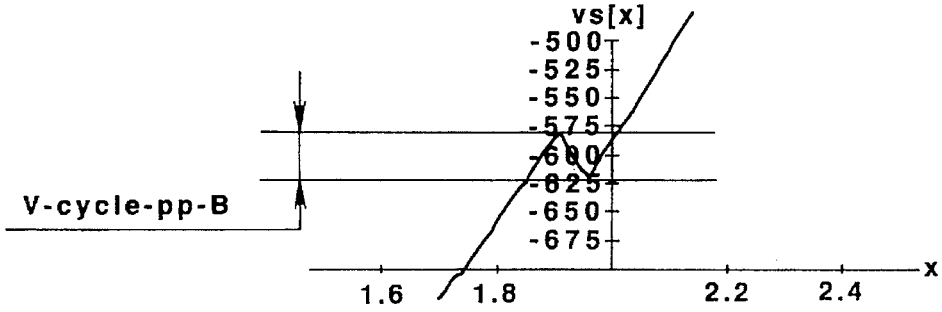
Figure 29:
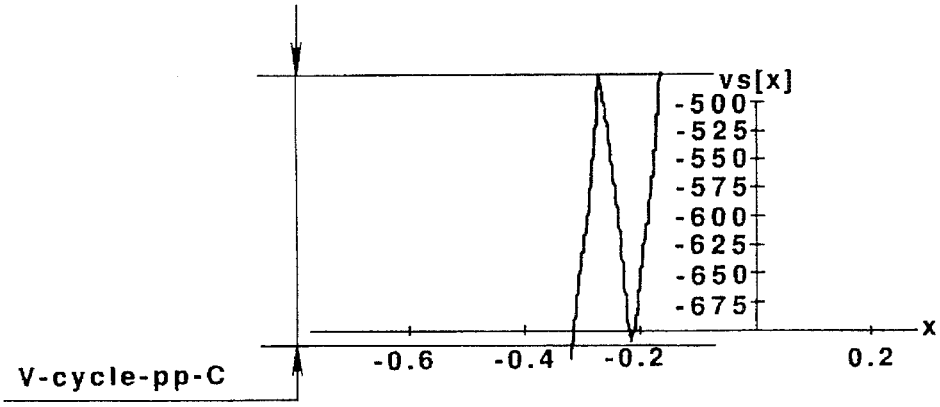

Each of portions indicated by A, B and C in FIG. 28(6) corresponds to the peak-to-peak voltage of the cycle pattern. FIGS. 29(1) through 29(3) are enlarged graphs of portions A, B and C of FIG. 28(6), respectively. In FIGS. 29(1) through 29(3), the ordinate represents the surface potential of the photosensitive drum, and the abscissa represents x. In the present embodiment, the peak-to-peak voltage (V-cycle-pp) has the following values:

| | |
|---|---|
| V-cycle-pp-A = 11.5 V | (FIG. 29 (1)) |
| V-cycle-pp-B = 39.3 V | (FIG. 29 (2)) |
| V-cycle-pp-C = 235.3 V | (FIG. 29 (3)). |

As is apparent from these results, the cycle pattern is gradually reduced from the upstream side to the downstream side in the direction of rotation of the photosensitive drum.

In regions B and C shown in FIG. 28(6), the surface potential of the photosensitive drum is repeatedly charged and discharged by the charging member. Hence, the averaging effect of potential is present as in the above-described embodiments.

In region A of FIG. 28(6), the averaging effect of the surface potential of the photosensitive drum is hardly recognized, since the peak-to-peak voltage (V-cycle-pp) is small. However, the cycle pattern becomes less noticeable. That is, by dividing the charged region into the averaging region of the surface potential of the photosensitive drum and the uniformly charged region, which is provided at the most downstream portion in the direction of rotation of the photosensitive drum, it is possible to provide a uniformly charged photosensitive drum free from a residual potential and the cycle pattern.

In image output in the above-described system, the cycle pattern was not recognized at all even in a halftone image, and excellent images free from the memory effect of the photosensitive drum were obtained.

That is, when a charging member provides a member to be charged with at least two charged regions, it is desirable to reduce the cycle pattern after charging by averaging unevenness in the surface potential before charging by increasing the peak-to-peak voltage of the cycle pattern in a charged region present at the upstream side in the moving direction of the member to be charged, and by reducing the peak-to-peak voltage of the cycle pattern in a charged region present at the downstream side in the moving direction of the member to be charged.

As described above, by providing at least two charged regions to be subsequently discharged in a member to be charged by a charging member, and making the peak-to-peak voltage of unevenness in charging in the most downstream region to be smaller than the peak-to-peak voltage in other regions, it becomes to possible to average the surface potential of the member to be charged, to make the cycle pattern less noticeable, and to reduce the frequency of the applied bias voltage. As a result, it becomes possible to suppress interference fringes and charging tone to a level of no importance.

The fact that the peak-to-peak voltage of the cycle pattern can be reduced indicates that the frequency of the applied bias voltage can be reduced at the same process speed. As a result, charging tone can also be reduced.

Figure 30:
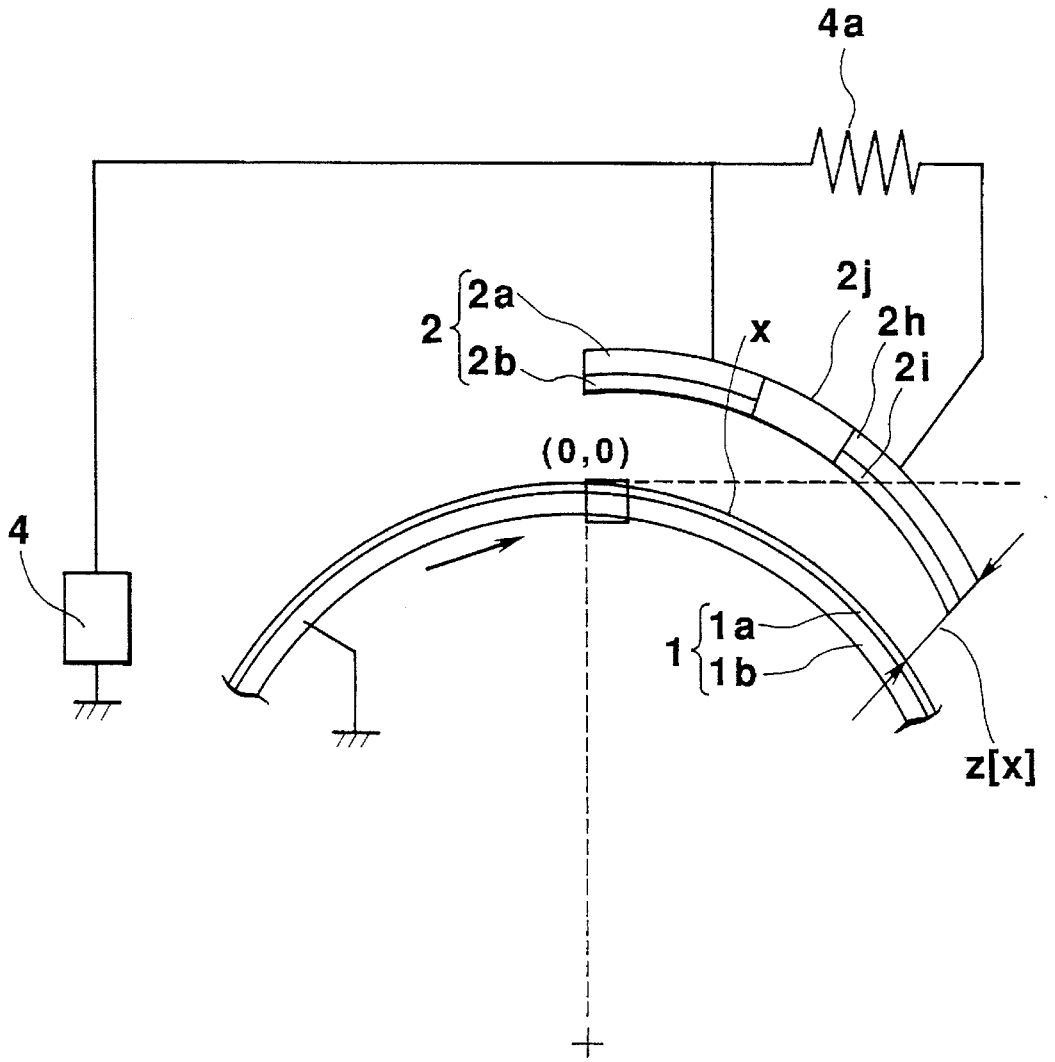
FIG. 30 is a diagram showing the schematic configuration of a principal portion of a charging member according to an eigth embodiment of the present invention.

FIG. 30 is a diagram showing the configuration of a charging member according to an eighth embodiment of the present invention.

In FIG. 30, insulator **2*j* divides charging member 2 into two portion, i.e., a portions, comprising electrode 2*a* and high-resistance layer 2*b*, and a portion comprising electrode 2*h* and high-resistance layer 2*i* having a volume resistivity greater than that of electrode 2*h*. The peak-to-peak voltage of the bias voltage applied from bias power supply 4 is reduced from the upstream side to the downstream side in the direction of rotation of the photosensitive drum. Resistor 4*a* has the function of reducing the peak-to-peak voltage from power supply 4. According to such a method of bias voltage application, the surface potential of the photosensitive drum is repeatedly charged and discharged by charging member 2** to which a high bias voltage is applied. Hence, the averaging effect of the surface potential is present as in the above-described embodiments.

In the most downstream portion, the peak-to-peak voltage (V-cycle-pp) is small. Hence, the averaging effect of the surface potential of the photosensitive drum is hardly recognized, but the cycle pattern becomes less noticeable.

Such an approach is not limited to the present embodiment. Also in the above-described charging members having various shapes, it is desirable that the peak-to-peak voltage of the cycle pattern of the charged region at the upstream side in the moving direction of the member to be charged is greater than the peak-to-peak voltage of the cycle pattern of the charged region at the downstream side in the moving direction of the member to be charged.

The above-described peak-to-peak voltages of the cycle pattern may be compared by developing the charged regions at the upstream side and the downstream side with toner and comparing the densities of the developed regions. It is desirable that the densities may be compared for halftone regions by adjusting the level of the developing bias voltage.

Next, a description will be provided of a method of supporting a charging member.

Figure 34:
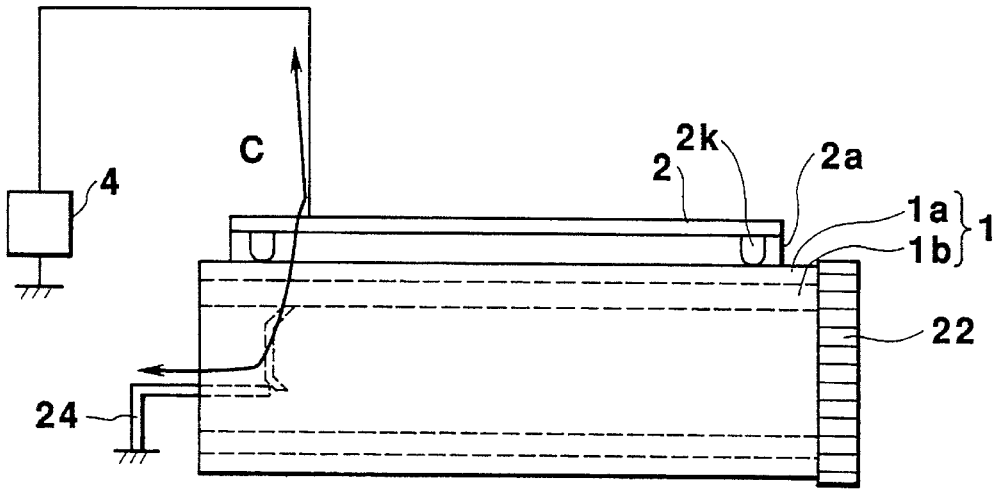
FIG. 34 is a diagram illustrating the manner of transmission of vibration from a charging member to a photosensitive drum.

As described above, charging tone is smaller when a charging member is separated from a member to be charged in the proximity thereof than when the charging member contacts the member to be charged. However, as shown in FIG. 34, if spacer 2*k* contacting a photosensitive drum, serving as the member to be charged, is provided in order to form a gap between the charging member and the member to be charged, an AC component flows along the route indicated by arrow C shown in FIG. 34. Hence, charging member 2 starts to oscillate, and the oscillation is transmitted to base member 1*b* of the photosensitive drum which is connected to ground 24, whereby charging tone is generated. FIG. 34 is obtained by viewing FIG. 15 from direction D.

In order to reduce the charging tone, it is preferable to fix the charging member to side plates of the main body of the apparatus. A description will be provided of a method of fixing the charging member with reference to FIG. 35 obtained by viewing FIG. 15 from a direction perpendicular to the longitudinal direction of the charging member (direction E shown in FIG. 15).

Figure 35:
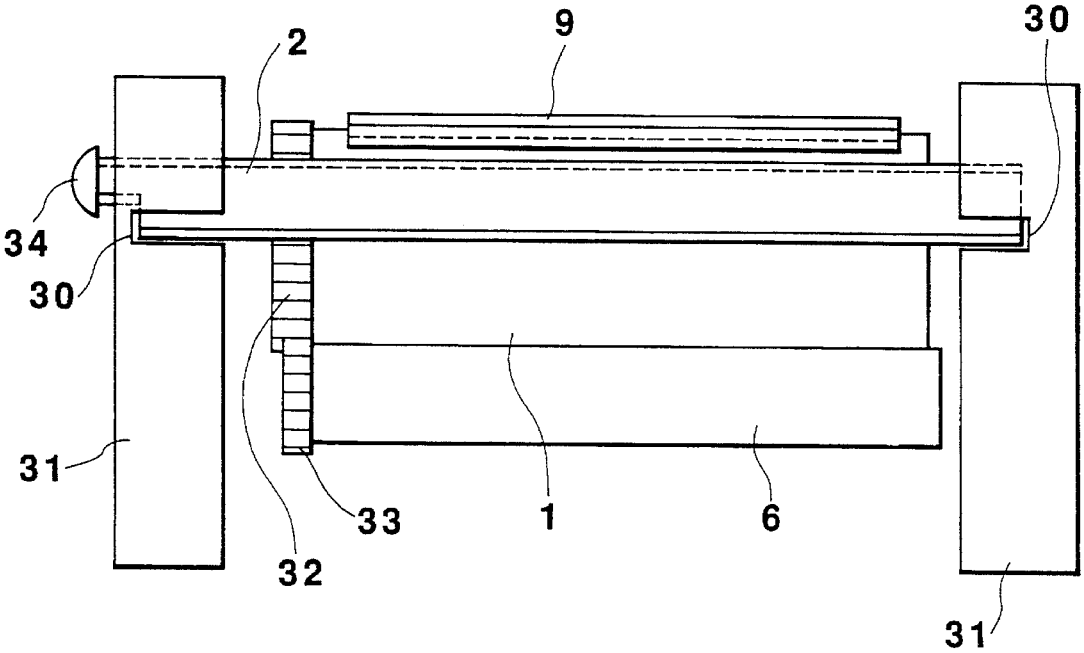
FIG. 35 is a side view showing a method of supporting a charging member.

In FIG. 35, reference numeral 31 represents side plates of the case of the main body of the apparatus. Reference numeral 34 represents a contact of charging member 2 for supplying a bias voltage from the outside. Holding holes 30 are provided at a front portion and a rear portion of each of side plates 21 in order to hold charging member 2.

In the above-described configuration, since charging member 2 is securely held in holding holes 30 of side plates 31, spacer 2*k* does not hit the photosensitive drum even if charging member 2 vibrates by applying an AC bias voltage superposed with a DC voltage thereto. Hence, charging tone is not generated at all. Furthermore, since the photosensitive drum and the charging member are fixed to the side plates, the gap between the photosensitive member and the charging member can be provided with a sufficient accuracy even if spacer 2*k* is not used. The result of measurement of noise in the above-described conditions indicates that noise becomes about 10 dB smaller than when spacer 2*k* is used.

In addition, since the charging member does not contact the photosensitive drum at all, the problem of peeling of the photosensitive layer on the surface of the photosensitive drum at the position of the spacer during durability tests is overcome.

In the above-described charging members having various shapes, from the viewpoint of reducing charging tone, it is desirable to support the charging member at the side plates of the case of the main body of the apparatus without providing a spacer for the charging member, as described above, when the charging member is provided in the proximity of the member to be charged. In p1ace of being supported at the side plates of the main body of the apparatus, the charging member may be supported at the frame of the cartridge.

The oscillating voltage applied to the charging member may have any appropriate waveform, such as a sine wave, a rectangular waves a triangular wave or the like, provided that the voltage periodically changes. A rectangular-wave voltage formed by periodically turning on and off a DC power supply may, of course, be used as the oscillating voltage.

It is desirable that the oscillating voltage has a peak-to-peak voltage at least twice the DC voltage applied to the charging member when charging of the member to be charged is started, that is, the charging start voltage. That is, by providing an oscillating voltage having a peak-to-peak voltage of at least twice the charging start voltage, the potential of the member to be charged after charging becomes substantially uniform irrespective of the potential of the member to be charged before charging. Accordingly, a previously-used preexposure lamp for uniformly exposing a photosensitive member, serving as a member to be charged, before charging becomes unnecessary. For example, as shown in FIG. 1, uniform exposure of the photosensitive member before primary charging after a transfer operation becomes unnecessary.

In the above-described embodiments, the term "line scanning" is not limited to irradiation of a laser beam in the longitudinal direction (the direction of the generatrix) of an image bearing member by rotation of a polygonal mirror, but includes recording of lines by disposing an LED (light-emitting diode) head provided by arranging LED devices in the longitudinal direction of the image bearing member so as to face it the image bearing member, and turning on and off the LED devices by signals from a controller.

The image bearing member is not limited to the photosensitive drum, but an insulator may also be used as the image bearing member. In such a case, a multistylus recording head obtained by arranging pin-like electrodes in the longitudinal direction of the image bearing member so as to face the image bearing member may be provided at the downstream side of the charging member in the moving direction of the surface of the image bearing member, and a latent image may be formed after charging. The image forming apparatus of the present invention may, of course, be applied to reversal development as well as normal development.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A charging device, comprising:

a movable member to be charged; and a charging member, adjacent to said movable member, for charging said movable member, an oscillating voltage being applied to said charging member, said charging member having a charging surface arranged at a same side of a tangent line as said movable member wherein the tangent line extends from a point on said charging member, the point being a most downstream point in a moving direction of said movable member at a closest portion between said charging member and said movable member, toward a downstream side in the moving direction of said movable member.

2. A charging device according to claim 1, wherein said charging member contacts said movable member.

3. A charging device according to claim 1, wherein said charging member does not contact said movable member.

4. A process cartridge, detachable to an image forming apparatus, said process cartridge comprising:

a movable image bearing member; and a charging member, adjacent to said image bearing member, for charging said image bearing member, an oscillating voltage being applied to said charging member, said charging member having a charging surface arranged at a same side of a tangent line as said image bearing member wherein the tangent line extends from a point on said charging member, the point being a most downstream point in a moving direction of said image bearing member at a closest portion between said charging member and said image bearing member, toward a downstream side in the moving direction of said image bearing member.

5. A process cartridge according to claim 4, further comprising a developing unit for developing a latent image on said image bearing member with toner.

6. A process cartridge according to claim 4, wherein said charging member contacts said movable image bearing member.

7. A process cartridge according to claim 4, wherein said charging member does not contact said movable image bearing member.

8. A process cartridge according to claim 4, wherein said charging member is arranged so as to curve from the closest portion toward the downstream side in the moving direction of said image bearing member.

9. A process cartridge according to claim 4, wherein said charging member comprises a plate-like member.

10. An image forming apparatus, comprising:

a movable image bearing member; and a charging member, adjacent to said image bearing member, for charging said image bearing member, an oscillating voltage being applied to said charging member, said charging member having a charging surface arranged at a same side of a tangent line as said image bearing member wherein the tangent line extends from a point on said charging member, the point being a most downstream point in a moving direction of said image bearing member at a closest portion between said charging member and said image bearing member, toward a downsteam side in the moving direction of said image bearing member.

11. An image forming apparatus according to claim 10, wherein said charging member is provided so as to curve from the closest portion toward the downstream side in the moving direction of said image bearing member.

12. An image forming apparatus according to claim 10, wherein a gap between said charging member and said image bearing member gradually increases from the closest portion toward the downstream side in the moving direction of said image bearing member.

13. An image forming apparatus according to any of claims 10, 11 and 12, wherein said charging member comprises a plate member.

14. An image forming apparatus according to claim 10, wherein a peak-to-peak voltage of unevenness in charging of a potential on said image bearing member is greater in the vicinity of the closest portion than in a downstream portion in the moving direction of said image bearing member.

15. An image forming apparatus according to claim 10, wherein the oscillating voltage comprises a superposed voltage including an AC voltage and a DC voltage.

16. An image forming apparatus according to claim 10, or 15, wherein the oscillating voltage includes a peak-to-peak voltage substantially equals at least twice a charging start voltage for said image bearing member.

17. An image forming apparatus according to claim 10, wherein in the downstream side from a closest portion in the moving direction of said image bearing member, the following condition is satisfied:

$$V_{ps}/f \leqq d_w,$$

where $d_w$ represents the width of a charged region in the moving direction, $V_{ps}$ represents a process speed of said image bearing member, and f represents a frequency of the oscillating voltage.

18. An image forming apparatus according to claim 10, wherein the following conditions are satisfied:

$$V_d=(V_a+V_b)/2,\ |V_d-V_a| \geqq V_{TH},\ \text{and}\ |V_d-V_b| \geqq V_{TH},$$

where $V_a$ represents a maximum value of the oscillating voltage, $V_b$ represents a minimum value of the oscillating voltage, $V_d$ represents a potential of a charged region on said image bearing member, and $V_{TH}$ represents a charging start voltage for said image bearing member.

19. An image forming apparatus according to claim 10, wherein said charging member is supported by a case of said apparatus.

20. An image forming apparatus according to claim 10, wherein said charging member contacts said movable image bearing member.

21. An image forming apparatus according to claim 10, wherein said charging member does not contact said movable image bearing member.

22. A charging device, comprising:

a movable member to be charged; and a charging member for charging said movable member, an oscillating voltage being applied to said charging member, wherein said charging member includes a first region for charging said movable member, and a second region provided at a downstream side in a moving direction of said movable member for charging said movable member, and wherein a distance between a surface of said charging member and a surface of said movable member is greater at said second region than at said first region, and with one of (i) said second region being substantially parallel to a tangent line of said movable member drawn from a point on said movable member being closest to said second region and (ii) said second region providing a substantially same curve as a curve of said movable member to which said second region faces.

23. A process cartridge detachable to an image forming apparatus, said process cartridge comprising:

a movable image bearing member; and a charging member for charging said image bearing member, an oscillating voltage being applied to said charging member, wherein said charging member includes a first region for charging said image bearing member, and a second region provided at a downstream side in a moving direction of said image bearing member for charging said image bearing member, and wherein a distance between a surface of said charging member and a surface of said image bearing member is greater at said second region than at said first region, and with one of (i) said second region being substantially parallel to a tangent line of said image bearing member drawn from a point on said image bearing member being closest to said second region, and (ii) said second region providing a substantially same curve as a curve of said image bearing member to which said second region faces.

24. A process cartridge according to claim 23, further comprising a developing unit for developing a latent image on said image bearing member with toner.

25. An image forming apparatus according to claim 23, wherein said charging member is contactable to said image bearing member, wherein said first region is arranged in a vicinity of a contact portion between said charging member and said image bearing member, and wherein said second region is arranged such that said charging member is adjacently non-contacting said image bearing member.

26. A process cartridge according to claim 23, wherein said charging member does not contact said image bearing member, and is adjacent said image bearing member at each of said first and second regions.

27. A process cartridge according to claim 25 or 26, wherein the distance between the surface of said charging member and the surface of said image bearing member is substantially constant at said second region.

28. A process cartridge according to claim 23, wherein said first region is separated by a predetermined distance from said second region.

29. A process cartridge according to claim 23, wherein said charging member comprises a plate member.

30. A process cartridge according to claim 23, wherein said charging member comprises a first plane provided in said first region and a second plane provided in said second region, said second plane crossing said first plane.

31. A process cartridge according to claim 23, wherein said charging member comprises a roller provided in said first region, and a plate member provided in said second region.

32. An image forming apparatus, comprising:

a movable image bearing member; and a charging member for charging said image bearing member, an oscillating voltage being applied to said charging member, wherein said charging member includes a first region for charging said image bearing member, and a second region provided at a downstream side in a moving direction of said image bearing member for charging said image bearing member, and wherein a distance between a surface of said charging member and a surface of said image bearing member is greater at said second region that at said first region, and with one of (i) said second region being substantially parallel to a tangent line of said image bearing member drawn from a point on said image bearing member being closest to said second region, and (ii) said second region providing a substantially same curve as a curve of said image bearing member to which said second region faces.

33. An image forming apparatus according to claim 32, wherein said charging member is contactable to said image bearing member, wherein said first region is provided in a vicinity of a contact portion between said charging member and said image bearing member, and wherein said second region is provided such that said charging member is adjacently non-contacting said image bearing member.

34. An image forming apparatus according to claim 32, wherein said charging member does not contact said image bearing member, and is adjacent said image bearing member at each of said first and second regions.

35. An image forming apparatus according to claim 32, wherein said first region is separated by a predetermined distance from said second region.

36. An image forming apparatus according to claim 33 or 34, wherein a distance between a surface of said charging member and the surface of said image bearing member is substantially constant at said second region.

37. An image forming apparatus according to any of claims 32, 33, 34 and 35, wherein said charging member comprises a plate member.

38. An image forming apparatus according to any of claims 32, 33, 34 and 35, wherein said charging member includes a first plane provided in said first region, and a second plane provided in said second region, said second plane crossing said first plane.

39. An image forming apparatus according to any of claims 32, 33, 34 and 35, wherein said charging member comprises a roller provided in said first region, and a plate member provided in said second region.

40. An image forming apparatus according to claim 34, wherein said charging member is supported by a case of said apparatus.

41. An image forming apparatus according to claim 32, wherein a peak-to-peak voltage of unevenness in potential of said image bearing member is greater in said first region than in said second region.

42. An image forming apparatus according to claim 32, wherein the oscillating voltage comprises a superposed voltage including an AC voltage and a DC voltage.

43. An image forming apparatus according to claim 32 or 42, wherein the oscillating voltage includes a peak-to-peak voltage which substantially equals at least twice a charging start voltage for said image bearing member.

44. An image forming apparatus according to claim 32, wherein in said second region, the following condition is satisfied:

$$V_{ps}/f \leqq d_w,$$

where $d_w$ represents a width of a charged region in the moving direction of said image bearing member, $V_{ps}$ represents a process speed of said image bearing member, and f represents the frequency of a oscillating voltage.

45. An image forming apparatus according to claim 32, wherein the following conditions are satisfied:

$$V_d=(V_a+V_b)/2,\ |V_d-V_a| \geqq V_{TH},\ \text{and}\ |V_d-V_b| \geqq V_{TH},$$

where $V_a$ represents a maximum value of the oscillating voltage, $V_b$ represents a minimum value of the oscillating voltage, $V_d$ represents a potential of a charged region in said image bearing member, and $V_{TH}$ represents a charging start voltage for said image bearing member.

46. A charging device, comprising:

a movable member to be charged; and a charging member, adjacent to said movable member, for charging said movable member, an oscillating voltage being applied to said charging member, wherein said charging member includes a first charging region, and a second charging region provided at a downstream side from said first charging region in a moving direction of said movable member, and wherein a peak-to-peak voltage of unevenness in charging of a potential of said first charging region is greater than a peak-to-peak voltage of unevenness in charging of a potential of said second charging region.

47. A charging device according to claim 46, wherein said charging member contacts said movable member.

48. A charging device according to claim 46, wherein said charging member does not contact said movable member.

49. A process cartridge, detachable to an image forming apparatus, said process cartridge comprising:

a movable image bearing member; and a charging member adjacent to said image bearing member, for charging said image bearing member, an oscillating voltage being applied to said charging member, wherein said charging member includes a first charging region, and a second charging region provided at a downstream side from said first charging region in a moving direction of said image bearing member, and wherein a peak-to-peak voltage of unevenness in charging of a potential of said first charging region is greater than a peak-to-peak voltage of unevenness in charging of a potential of said second charging region.

50. A process cartridge according to claim 49, further comprising a developing unit for developing a latent image on said image bearing member with toner.

51. A process cartridge according to claim 49, wherein said charging member contacts said movable image bearing member.

52. A process cartridge according to claim 49, wherein said charging member does not contact said movable image bearing member.

53. A process cartridge according to claim 49, wherein the distance between said first charging surface and the surface of said image bearing member substantially equals a distance between said second charging surface and the surface of said image bearing member.

54. A process cartridge according to claim 53, wherein each of said first and second charging surfaces comprises a shape configured to follow a facing surface of said image bearing member.

55. An image forming apparatus, comprising:

a movable image bearing member; and a charging member adjacent to said image bearing member, for charging said image bearing member, an oscillating voltage being applied to said charging member, wherein said charging member includes a first charging region, and a second charging region provided at a downstream side from said first charging region in a moving direction of said image bearing member, and wherein a peak-to-peak voltage of unevenness in charging of a potential of said first charging region is greater than a peak-to-peak voltage of unevenness in charging of a potential of said second charging region.

56. An image forming apparatus according to claim 55, wherein the oscillating voltage comprises a superposed voltage including an AC voltage and a DC voltage.

57. An image forming apparatus according to claim 55 or 56, wherein the oscillating voltage includes a peak-to-peak voltage which substantially equals at least twice a charging start voltage for said image bearing member.

58. An image forming apparatus according to claim 55, wherein in said second region, the following condition is satisfied:

$$V_{ps}/f \leqq d_w,$$

where $d_w$ represents a width of a charged region in the moving direction of said image bearing member, $V_{ps}$ represents a process speed of said image bearing member, and f represents a frequency of the oscillating voltage.

59. An image forming apparatus according to claim 55, wherein the following conditions are satisfied:

$$V_d=(V_a+V_b)/2,\ |V_d-V_a| \geqq V_{TH},\ \text{and}\ |V_d-V_b| \geqq V_{TH},$$

where $V_a$ represents a maximum value of the oscillating voltage, $V_b$ represents a minimum value of the oscillating voltage, $V_d$ represents a potential of a charged region in said image bearing member, and $V_{TH}$ represents a charging start voltage for said image bearing member.

60. An image forming apparatus according to claim 55, wherein said charging member is supported by a case of said apparatus.

61. An image forming apparatus according to claim 55, wherein said charging member includes a first charging surface provided in said first region, and a second charging surface provided in said second region, and wherein a peak-to-peak voltage of the oscillating voltage applied to said first charging surface is greater than a peak-to-peak voltage of the oscillating voltage applied to said second charging surface.

62. An image forming apparatus according to claim 61, wherein the distance between said first charging surface and a surface of said image bearing member substantially equals the distance between said second charging surface and the surface of said image bearing member.

63. An image forming apparatus according to claim 62, wherein each of said first and second charging surfaces comprises a shape to follow the facing surface of said image bearing member.

64. An image forming apparatus according to any of claims 61, 62 and 63, wherein said first charging surface and said second charging surface are electrically isolated from each other.

65. An image forming apparatus according to claim 55, wherein said charging member contacts said movable image bearing member.

66. An image forming apparatus according to claim 55, wherein said charging member does not contact said movable image bearing member.

* * * * *

UNITED STATES PATENT AND TRADEMARK OFFICE

CERTIFICATE OF CORRECTION

PATENT NO. : 5,475,471

DATED : December 12, 1995

INVENTOR(S) : HIROKI KISU, et al.

It is certified that error appears in the above-indentified patent and that said Letters Patent is hereby corrected as shown below:

ON THE TITLE PAGE:

[54] In the Title

"CHANGING" should read --CHARGING--.

COLUMN 1

Line 1, "CHANGING" should read --CHARGING--.

COLUMN 2

Line 20, "comprising a" should read --comprising an--.
Line 23, "voltage Vdc," should read --voltage $V_{dc}$,--.

COLUMN 3

Line 66, "incluing" should read --including--.

COLUMN 4

Line 62, "An additional" should read --A--.

COLUMN 6

Line 25, "becomes" should read --become--.
Line 26, "paper" should read --paper,--.
Line 27, "roller 20" should read --roller 20--.

UNITED STATES PATENT AND TRADEMARK OFFICE

CERTIFICATE OF CORRECTION

PATENT NO. : 5,475,471

DATED : December 12, 1995

INVENTOR(S) : HIROKI KISU, et al.

It is certified that error appears in the above-indentified patent and that said Letters Patent is hereby corrected as shown below:

COLUMN 7

Line 13, "f=VpxD÷(25.4xM/M).....(4)," should read --f = $V_p$ x D ÷ (25.4 x N/M).....(4),--.
Line 40, "roler 21" should read --roller 20--.

COLUMN 11

Line 30, "correcion" should read --correction--.

COLUMN 12

Line 1, "vq(t, n)=½xvpp sin (2 πft(n-1)+dc .....(13)," should read

--vq (t,n) = ½ x vpp sin (2π ft (n-1)) + dc .....(13), --.

COLUMN 14

Line 26, "of" should read --of a--.

COLUMN 15

Line 37, "can," should read --can--.
Line 43, "p1ace" should read --place--.
Line 60, "Portion" should read --A portion--.

UNITED STATES PATENT AND TRADEMARK OFFICE

CERTIFICATE OF CORRECTION

PATENT NO. : 5,475,471 Page 3 of 4

DATED : December 12, 1995

INVENTOR(S) : HIROKI KISU, et al.

It is certified that error appears in the above-indentified patent and that said Letters Patent is hereby corrected as shown below:

COLUMN 16

Line 31, "interval)," should read --interval)),--.
Line 54, "rs(x,n)" should read --vs(x,n)--.
Line 57, "rs(x,n)" should read --vs(x,n)--.

COLUMN 19

Line 25, "digram" should read --diagram--.

COLUMN 22

Line 24, "FIG. 28(8)" should read --FIG. 25(3)--; and "n323," should read --n=3,--.

COLUMN 26

Line 32, "portion, i.e., a portions," should read --portions, i.e., a portion--.

COLUMN 27

Line 48, "place" should read --place--.
Line 54, "waves" should read --wave,--.

UNITED STATES PATENT AND TRADEMARK OFFICE

CERTIFICATE OF CORRECTION

PATENT NO. : 5,475,471 Page 4 of 4

DATED : December 12, 1995

INVENTOR(S) : HIROKI KISU, et al.

It is certified that error appears in the above-indentified patent and that said Letters Patent is hereby corrected as shown below:

COLUMN 28

Line 13, "it" should be deleted.

COLUMN 29

Line 54, "claim 10," should read --claim 10--.
Line 56, "voltage" should read --voltage which--.
Line 59, "a" should read --the--.
Line 65, "the width" should read --a width--.

COLUMN 31

Line 58, "a surface" should read --the surface--.

COLUMN 32

Line 9, "in" should read --in a--.
Line 28, "the" should read --a--; and "a" should read --the--.

Signed and Sealed this

Eleventh Day of June, 1996

Bruce Lehman

*Attest:*

BRUCE LEHMAN

*Attesting Officer*

*Commissioner of Patents and Trademarks*